US011058169B2

(12) United States Patent
Comstock et al.

(10) Patent No.: US 11,058,169 B2
(45) Date of Patent: Jul. 13, 2021

(54) RANDOM VARIABLE STIMULUS INSOLES AND FOOTWEAR TO OPTIMIZE HUMAN NEUROMUSCULAR GAIT MECHANICS

(71) Applicant: Biopods, LLC, Lake Forest, IL (US)

(72) Inventors: Bruce Comstock, Richmond Hill (CA); Steve Horvath, Uxbridge (CA)

(73) Assignee: Biopods, LLC, Lake Forest, IL (US)

( * ) Notice: Subject to any disclaimer, the term of this patent is extended or adjusted under 35 U.S.C. 154(b) by 104 days.

(21) Appl. No.: 15/817,204

(22) Filed: Nov. 18, 2017

(65) Prior Publication Data

US 2018/0140041 A1 May 24, 2018

Related U.S. Application Data

(60) Provisional application No. 62/424,123, filed on Nov. 18, 2016.

(51) Int. Cl.
*A43B 13/04* (2006.01)
*A43B 13/18* (2006.01)
(Continued)

(52) U.S. Cl.
CPC ..... *A43B 7/146* (2013.01); *A43B 1/0009* (2013.01); *A43B 7/141* (2013.01); *A43B 7/142* (2013.01);
(Continued)

(58) Field of Classification Search
CPC ..... A43B 7/146; A43B 13/04–13/187
See application file for complete search history.

(56) References Cited

U.S. PATENT DOCUMENTS 3,771,529 A * 11/1973 Matteson ..... A43B 7/1465 36/156
4,760,655 A 8/1988 Mauch
5,014,706 A 5/1991 Philipp
5,682,690 A * 11/1997 Chang ..... A43B 7/00 36/11.5
(Continued)

FOREIGN PATENT DOCUMENTS

WO 2012127109 9/2012

OTHER PUBLICATIONS

International Search Report of the International Searching Authority prepared by the USPTO in connection with PCT/US2017/062438, dated Mar. 22, 2018; Entire Document (5 pages).

*Primary Examiner* — Jila M Mohandesi
(74) *Attorney, Agent, or Firm* — K&L Gates LLP

(57) ABSTRACT

A midsole or insole device for a shoe includes a first variable stimulation mechanism positioned to interface one of the metatarsal heads and the heel and a second variable stimulation mechanism positioned to interface a lateral aspect of the foot between the fifth metatarsal head and the heel. During gait-related activities, the first variable stimulation mechanism produces stimulus of an intensity greater than the second variable stimulation mechanism. At least one of the first variable stimulation mechanism and the second variable stimulation mechanism comprises two bonded layers including a resilient stimulating upper layer and a less resilient stimulus-enhancing lower layer. The upper layer includes a plurality of holes that pass through the entirety of the upper layer, and the lower layer includes a plurality of equally spaced upwardly facing projections aligned substantially perpendicular to an upper surface of the upper layer.

5 Claims, 9 Drawing Sheets

(51) Int. Cl.

| | |
|---|---|
| ***A43B 13/14*** | (2006.01) |
| ***A43B 7/14*** | (2006.01) |
| ***A43B 1/00*** | (2006.01) |
| ***A43B 13/12*** | (2006.01) |
| ***A43B 17/00*** | (2006.01) |
| ***A43B 17/02*** | (2006.01) |
| ***A43B 17/14*** | (2006.01) |

(52) U.S. Cl.
CPC ..... *A43B 13/04* (2013.01); *A43B 13/125* (2013.01); *A43B 13/127* (2013.01); *A43B 13/14* (2013.01); *A43B 13/141* (2013.01); *A43B 13/187* (2013.01); *A43B 17/006* (2013.01); *A43B 17/02* (2013.01); *A43B 17/14* (2013.01)

(56) References Cited

U.S. PATENT DOCUMENTS

| | | | | |
|---|---|---|---|---|
| 6,076,282 | A * | 6/2000 | Brue' | A43B 7/081 36/141 |
| 6,732,457 | B2 * | 5/2004 | Gardiner | A43B 7/141 36/155 |
| 7,617,618 | B2 * | 11/2009 | Ahlbaumer | A43B 7/06 36/147 |
| 9,918,512 | B2 * | 3/2018 | Lazarchik | A43B 13/386 |
| 2006/0213091 | A1 * | 9/2006 | Ometto | A43B 7/081 36/141 |
| 2008/0022561 | A1 | 1/2008 | Klavano | |
| 2010/0192408 | A1 * | 8/2010 | Righetto | A43B 7/1415 36/29 |
| 2013/0160331 | A1 | 6/2013 | Burke et al. | |
| 2013/0312280 | A1 | 11/2013 | Gardiner | |
| 2013/0318818 | A1 * | 12/2013 | Gardiner | A43B 7/141 36/43 |

* cited by examiner

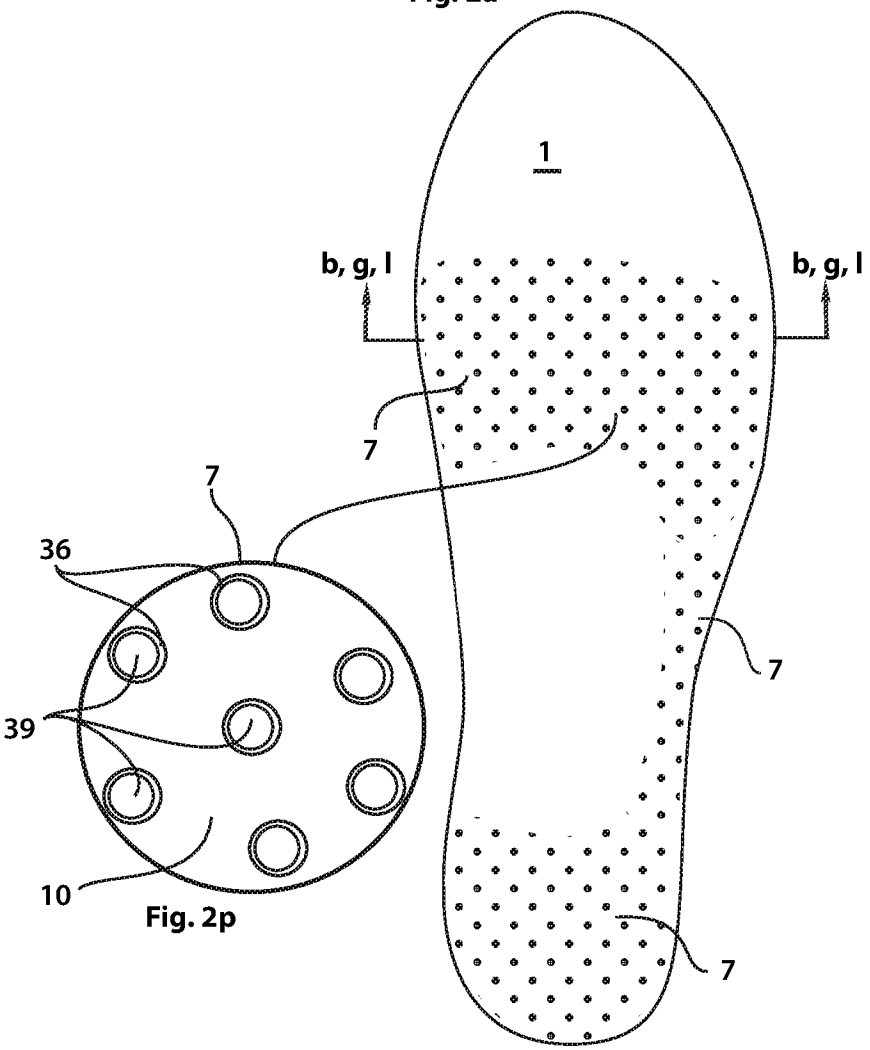
Fig. 2a
Fig. 2p
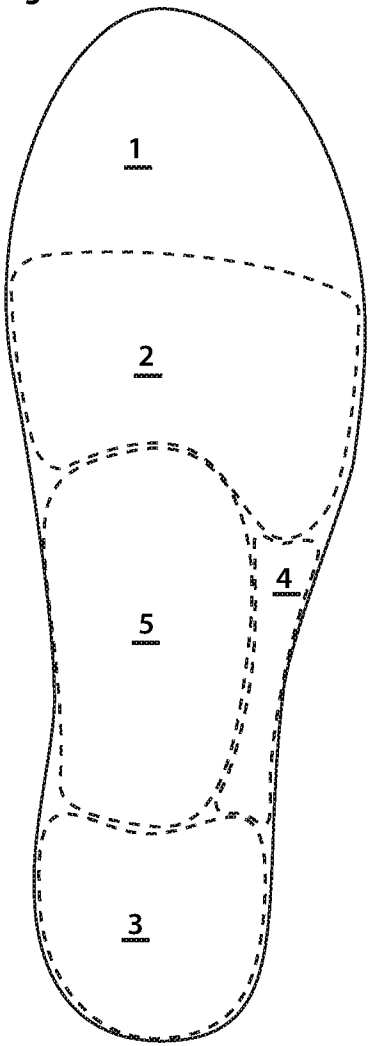
Fig. 1

7
7 / 13
7 / 14
10
11
12
30
31
32
33
34
35
36
37
39

45

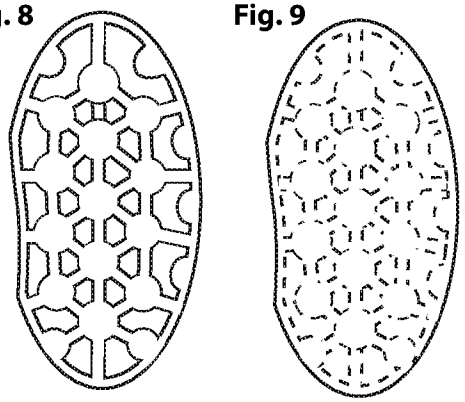
Fig. 8
Fig. 9
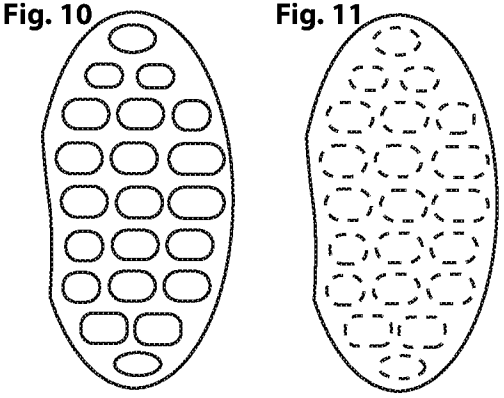
Fig. 10
Fig. 11
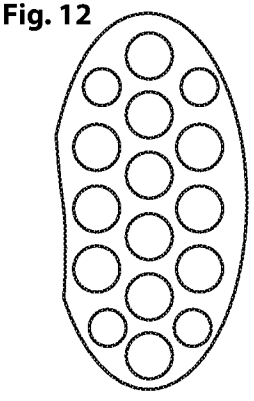
Fig. 12
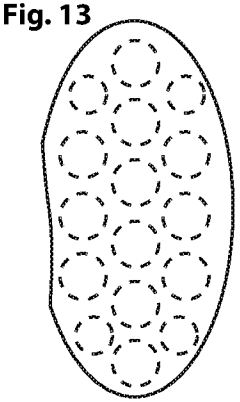
Fig. 13
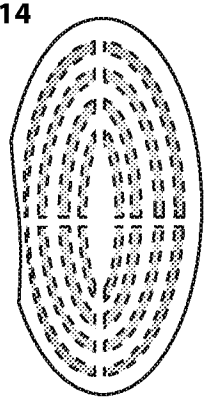
Fig. 14

RANDOM VARIABLE STIMULUS INSOLES AND FOOTWEAR TO OPTIMIZE HUMAN NEUROMUSCULAR GAIT MECHANICS

CROSS-REFERENCE TO RELATED APPLICATIONS

This application incorporates by reference and claims the benefit of priority to U.S. Provisional Application No. 62/424,123, filed on Nov. 18, 2016.

BACKGROUND OF THE INVENTION

The present invention relates to an insole for a shoe, or a shoe midsole. In particular the invention relates to an insole or shoe midsole that can provide variable stimulus, in intensity and location, to the sole of a foot, sufficient to activate an optimal neuromuscular protective reflex mechanism response throughout the wearer's feet, legs, hips and back such that the related musculoskeletal systems safely and efficiently manage the forces created during gait-related activities.

Professionals who deal with gait-related pathologies generally accept that a large majority of people will suffer from gait-related pain or dysfunction, at some time in their lives. It is also well accepted that, the majority of gait-related pain and dysfunction is related to faulty biomechanical function in the foot.

Over the past one hundred years it has been commonly theorized that the feet are inherently weak and incapable of safely managing the gait-related stresses and shock forces naturally generated as people go about their daily lives especially during high intensity activities. These theories have led to the common belief that the feet require and or benefit from footwear, insoles, and orthotics that artificially support and or cushion the feet as a means to mitigate the symptoms of the aforementioned gait-related stresses. Over this period, virtually all of those skilled in the art of footwear, insole, and orthotic design and manufacturing have developed technologies, designs, materials, and inventions intended to address the foot's perceived incapability's and weaknesses. A few of such devices are disclosed in U.S. Pat. No. 2,1,281,987 A to Heinlich et al; in U.S. Pat. No. 2,221,202 A to Ratcliff; in U.S. Pat. No. 4,124,946 A to Tomlin; in U.S. Pat. No. 4,510,700 A to Brown; in U.S. Pat. No. 5,014,706 A to Philipp; in U.S. Pat. No. 5,787,610 A to Brooks; in U.S. Pat. No. 6,345,455 B1 to Greer et al; in U.S. Pat. No. 6,425,194 B1 to Brie; in U.S. Pat. No. 6,282,816 to Rosendahl; in U.S. Pat. No. 6,802,138 B2 to McManus et al; in U.S. Pat. No. 7,140,126 B2 to Crane et al; in U.S. Pat. No. 7,644,522 B2 to Ramirez et al; in U.S. Pat. No. 7,610,696 B2 to Davis; in U.S. Pat. No. 7,707,751 B2 to Avent et al; in U.S. Pat. No. 7,958,653 B2 to Howlett et al; in U.S. Pat. No. 8,109,014 B2 to Miller et al; in U.S. Pat. No. 8,256,142 B2 to Igdari; in U.S. Pat. No. 8,4789,413 B2 to Avent et al; in U.S. Pat. No. 8,584,376 to Ahlbaumer; in U.S. Pat. No. 8,819,961 B1 to Ellis; in U.S. Pat. No. 9,107,427 B2 to Donzis et al; and in U.S. Publication. No. 20,060,080,869 A1 by Johnson.

However, virtually all conventional footwear, and all of these types of devices, interfere with or inhibit healthy natural neuro-musculoskeletal function throughout the lower limbs, hips, and back in some way, as described below.

Research shows that the vast majority of habitual shoe-wearing populations experience some form of foot-related pain or pathology and that, in comparison, less than three percent of habitually barefoot (non-shoe wearing) populations develop debilitating foot-related problems. Researchers have also shown a direct relationship between foot-related problems and footwear use with some researchers stating that footwear actually causes the problems.

Many conventional footwear and foot care product (insole and orthotic) manufacturers incorporate the aforementioned devices that are intended to provide additional support and or cushioning to the feet as a means to prevent and or alleviate foot-related symptoms. This is in stark contrast to the considerable research that has demonstrated that when the limbs of the human body are artificially supported or braced and/or when the natural environmental stimuli are dampened (cushioned) the affected limbs atrophy and become less functionally capable, and become increasingly dependent upon the artificial support and or cushioning.

In actuality, the feet are not inherently weak and incapable of safely managing the naturally generated gait-related forces. More significantly, the habitual use of conventional footwear has simply trained the foot, leg, hip, and back neuromuscular systems to function poorly over time.

To date, virtually all of those skilled in the art of footwear, insole, and orthotic design and manufacture have not only failed to fully understand the complexity of the human body's gait-related systems, by focusing on addressing what they perceive as a inherently "weak", they have failed to contemplate or comprehend how their inventions and designs negatively impact the neuro-musculoskeletal gait-related systems as a whole.

To fully understand the novelty of the invention described herein vs the conventional supportive and cushioning teachings, one must have a basic understanding of the human body's gait-related neuro-musculoskeletal systems and how they function.

An essential, defining structure of human gait is as follows. It is useful to categorize the ability of the human body to stand and walk (i.e., gait capacity) on two feet as one of the many, "physiologic systems" that maintain life in its ideal state. (Examples of these systems include: ph balance; sugar level regulation; temperature regulation; satiety; blood pressure regulation; hormone balance; etc). In this regard a "physiologic system"—at its most basic definition—entails: sensory input; central processing (i.e., the brain); and modulating/corrective output (in "feedback loops"), as a means of regulating that system. The ideal "system" can: sense; react to; and thus tolerate considerable perturbations (i.e., disturbances/challenges to its regulatory capacity) and, as such, would be considered as maximally "robust". This gait capacity operates via the human neuro-musculoskelatal systems.

The human body's neuromuscular functional capability is determined by daily activities and environmental influences.

The human body's neuro-musculoskeletal gait-related systems are comprised of:

- The Skeletal System (bone and cartilage)
- The Musculature System (muscle, ligaments, and fascia)—Facilities the individual and collective movement of the individual bones of the Skeletal System and stabilizes the bones at the joints.
- The Central Nervous System—Receives sensory, and sends motor, information required to activate the appropriate muscle activations as may be required to control skeletal movement. Contains the following inherent systems:
  - Cutaneous Mechanoreceptors—Sensory receptor nerve endings located in skin, muscles, and around joints; When they receive stimulus they begin to fire impulses at elevated frequency (i.e., the stronger the stimulus, the higher the frequency).

Nociceptors—Sensory neurons that are found in any area of the body that can sense noxious stimuli either externally or internally (in skin, muscle, tendons and joints).

Proprioceptive system—Nerve endings in muscles around joints (provide spatial positioning information of limbs and limb parts in relation to each other and the body core).

Motor neurons—Stimulate muscle contractions (one motor neuron does not stimulate the entire muscle but only a number of muscle fibers within a muscle).

Vestibular system—Inner ear related vestibular nuclei exchange sensory information with the various gait-related neuro-pathways that are responsible for the sense of balance and spatial orientation and the coordination of movement with balance.

Visual system—Involved in the identification and categorization of visual objects, assessing distances to and between objects, and guiding body movements in relation to the objects seen.

Brain—Receives sensory information from sensory nerve endings processes that information and sends signals to activate muscle contractions as may be required. The brain also directs conscious movement of the limbs related to accomplishing a specific activity (i.e., walking, running, jumping, etc.).

Reflex mechanisms—Involuntary (unconscious) muscle activations in response to anticipated or experienced harmful ("noxious") sensory stimulus originating from the aforementioned neuro-pathways.

The Central Nervous System also exhibits habituation and adaptation behaviours. Habituation is a behavioural phenomenon while neural adaptation is a physiological phenomenon, although the two are not entirely separate. During habituation, a person has some conscious control over whether they notice something to which they have become habituated. However, when it comes to neural adaptation, a person has no conscious control over it. Neural adaptation is tied very closely to stimulus intensity; as the intensity of a stimulus increases, the senses will adapt more strongly to it. In comparison, habituation can vary depending on the stimulus. With a weak or constant stimulus habituation can occur immediately, but with a strong or varied stimulus the person may not habituate at all. Once a behaviour has become habitual it will become the "reflexive" functional norm until the body is forced to adapt to a new stimulus that is stronger or more varied over an extended period of time.

All of the aforementioned neuro-musculoskeletal gait-related systems are synergistically interrelated, i.e., what affects one system also affects all other systems. All systems are involved simultaneously, at all times, during all gait-related activities. In addition, all systems exhibit plasticity—the ability to change and adapt in shape, robustness, and function in response to the environment in which they function and to how they are used within that environment. The central nervous system starts its adaptation to new circumstances immediately. The muscle system adaptation can be observed in as little as one or two days (such as seen when strengthening or stretching a muscle). Skeletal system adaptation can be observed within one to two weeks (such as seen when a broken bone begins to knit).

With virtually all individuals, except those with severe genetic deformities or those who have suffered irreversible, debilitating trauma, joint fusion, severe degeneration, etc., there is a "sweet spot" for optimal neuro-musculoskeletal function, i.e., stressors during functional use enhance the capabilities of the structure—"healthy" stress. Each individual's neuro-musculoskeletal sweet spot is both encouraged and enhanced by activities (movements) that promote a balance of strength and flexibility (in opposing muscle groups) at the joints.

Regular (i.e., everyday) activities or movements that facilitate the neuro-musculoskeletal sweet spot result in optimal neuromuscular (proprioceptive) conditioning. In the world of athletics, optimal neuromuscular conditioning is also known as "training with proper technique", which safely increases the neuro-musculoskeletal structure's functional capabilities (strength/robustness) while reducing the risk of injury (degenerative stress).

Healthy adaption is observed when the neuro-musculoskeletal systems become stronger, more robust and more capable in response to being challenged to do their job. The more regular and varied the exercise, the more capable the body becomes.

Conversely, the neuro-musculoskeletal gait-related systems (mal)adapt: when they are not challenged to do their job on a regular basis due to a lack of use, lack of stimulus, and or restriction of movement, they atrophy; or if they are repeatedly pushed beyond their functional capabilities at any given time they experience overuse related cumulative trauma.

The majority of gait-related neuro-musculoskeletal pathology (aside from severe genetic deformities) is caused by acute trauma (accident, fall, etc.) or by the degenerative stresses resulting from poor/inefficient neuro-musculoskeletal function, either chronically (overtime) or acutely (with increased activity levels).

For most individuals (aside from those with severe genetic deformities), poor/inefficient gait-related neuro-musculoskeletal function is a conditioned or trained response to their everyday activities and movements. That is, regardless, of genetic predisposition, each individual's daily activities can cause, contribute to, or exacerbate poor/inefficient gait-related neuro-musculoskeletal function.

Regular (i.e., everyday) activities or movements that facilitate poor/inefficient gait-related neuro-musculoskeletal function result in maladaptive neuromuscular (proprioceptive) conditioning (i.e., poor technique) which progressively decreases the gait-related neuro-musculoskeletal systems functional capabilities (i.e., weakens) and increases risk of injury (i.e, promotes degenerative stress). In this situation, stressors created during functional use exceed those of the "sweet spot", as the gait-related neuro-musculoskeletal systems are pushed beyond their "safe" or healthy tolerances, resulting in the degenerative stresses that cause, contribute to, or exacerbate systematic breakdowns and disease. The phrase "use it or lose it" is often applied to neuro-musculoskeletal functional capabilities.

The body's natural reflexive ("protect itself") gait-related neuromuscular adaptations that the lower limb, hip and back neuro-musculoskeletal systems utilize to compensate for the mechanical inefficiency often lead to an imbalance of strength/weakness and flexibility/inflexibility (in opposing muscle groups) and stiffness/pain at the joints or in the muscles, often, long after the actual stressor has passed.

Even though people have different capabilities for accommodating stress, each person ultimately has a breaking point. Given enough stressors of a high enough intensity for a long enough period of time, anybody will (mal)adapt.

A routine of gait-related activities and exercise programs that do not promote "Proper Technique" will facilitate maladaptation, as will the regular use of any external device that restricts the body's movement (supports or braces) or dampens sensory input (cushions). Functional and anatomical maladaptation is commonly observed when a limb is removed from a cast or splint and exhibits muscle atrophy, joint stiffness, and loss of bone mass. Bunions are another example of anatomical maladaptation.

Since the gait-related neuro-musculoskeletal gait-related systems inherently exhibit plasticity, maladaptation can be easily reversed by simply routinely challenging these systems to do their job by employing "Proper Technique" gait-related activities. Conversely, a healthy functioning body will maladapt when not challenged on a regular basis (with the required stimulus and freedom of movement).

Optimal gait-related neuro-musculoskeletal mechanics are observed when a person habitually walks or runs barefoot on natural terrain. Short term neural adaptations occur in the body during rhythmic activities. One of the most common activities when these neural adaptations are constantly happening is walking. As a person walks, the body constantly gathers information about the environment [terrain contact surface (angle, texture, hard, soft, slippery, etc.), obstacles, rate of movement, etc.], and the surroundings of the body. The sensory input gathered during each step triggers a protective reflex response throughout the limb (foot, leg, and hip) that is off the ground, in preparation for the next step's ground contact relative to the forces anticipated. With each step, muscle use throughout the lower limbs adjusts slightly according to the terrain and activity levels to align the bones throughout the lower limbs, hips and back to ensure the most efficient, safest, and stress free management of the forces generated. In the feet, extrinsic foot muscles act to dynamically align the bones of foot [i.e., form a multitude of arches or dome-like shape (commonly called the Windlass Effect or Windlass Mechanism)] to provide a stable platform for the rest of the body. The apex of these dome-like arches rises and falls dynamically relative to the forces being generated. The greater the forces the higher the apex and the greater the arches' load-bearing capabilities.

From a mechanical architecture perspective, the Keystone and apex of the dome-like arches created by the bones of the foot is the intermediate cuneiform bone, and the metatarsal heads and calcaneus bone form the dome-like arch system's supporting base or Springers. When Keystone is effectively locked in place by the muscle activations that create the Windlass Effect, the arch system has the greatest structural strength, and the mechanical loading forces are borne by the Springers, the sole of the foot's primary load-bearing areas. If the Keystone is not locked in place by the appropriate muscle activations the arch system loses its structural strength, and the mechanical loading forces are borne spread throughout the sole of the foot.

Optimal gait-related neuromuscular protective reflex activations occur when the load-bearing stimulus to the sole of the foot subtly varies in location and intensity during each step and from step to step. I.e., when the load-bearing forces to the sole of the foot are, for the most part, borne by the sole of the foot's primary or secondary load-bearing areas and when, within these load-bearing areas, subtle random localized pressure differences are created by small variations in the contours and texture of the terrain. On the other hand, repetition from a step to step, localized stimulus to the sole of the foot, such as is created by a small piece of sand or grit in ones shoe, will cause neuromuscular protective reflex activations that cause the person to limp as a means of avoiding the irritant. Overtime, if the repetitively localized irritant is not removed, the compensatory neuromuscular function will become the maladaptive norm.

The sole of the foot's primary and optimal load-bearing areas are located under the metatarsal heads and heel (i.e., the Springers). When habitually barefoot the skin and soft tissue under the primary load-bearing areas are the thickest, most robust, and least sensitive. Ideally, during gait-related activities, the load-bearing forces shift throughout the sole of the foot's primary load-bearing surface areas, as the lower limb manages those forces, relative to the positioning of the body's center of mass during multidirectional activities. These primary load-bearing areas are the most capable of safely accommodating the loads created during higher intensity gait-related activities (such as running and jumping). The loads to these areas are directly related to the height and mechanical integrity of the reflex activated dome-like arches in relation to the activity intensity. If the integrity of the arch Keystone or apex is maintained the load-bearing forces are focused at small randomly localized areas throughout the sole of the foot's primary load-bearing areas, much like a rippling effect. If the gait-related neuromuscular protective reflex activations do not occur or are insufficient to maintain the integrity of the foot's dome-like arches' Keystone or apex relative to the load-bearing forces generated, the dome-like arches progressively collapse causing the loading-forces to be spread over an increasingly greater sole-of-the-foot surface area. This dissipates both the intensity and the degree of randomly localized stimulation to the sole of the foot which, with repetition, results in habituated maladaptive neuromuscular function. Conversely, trauma and compensatory maladapted neuromuscular function can occur, when load-bearing forces are repetitively focused at one small location or a few small locations on the sole of the foot within the primary load-bearing areas.

If the load-bearing forces generated during a gait-related activity exceed the structural capabilities of the reflex activated dome-like arches, the sole of the foot's secondary load-bearing area becomes involved in accommodating the loads generated. The secondary load-bearing area is located along the lateral aspect of the foot between the fifth metatarsal head and the heel. When habitually barefoot the skin under the secondary load-bearing area is less thick, less robust, and more sensitive compared to the primary load-bearing points. Varied and randomly focused load-bearing stimulus to the secondary load-bearing area triggers the neuromuscular protective reflex activations required to raise and stabilize the arch Keystone (apex) thereby enhancing the mechanical integrity of the dome-like arches, and increasing the dome-like arches load-bearing capabilities (i.e., the loads become more focused at the primary load-bearing areas). Repetitively unvaried and uniformly focused stimulus to the secondary load-bearing area results in habituated maladaptive neuromuscular function. Trauma and compensatory maladapted neuromuscular function can occur, when load-bearing forces are repetitively focused at one small or a few small sole-of-the-foot surface area locations within the primary load-bearing areas.

If the loads generated during a gait-related activity exceed the structural capabilities of the dome-like arches and the sole of the foot's secondary load-bearing area, as the arches collapse due to the increasing forces, the load-bearing forces become increasingly spread over the sole of the foot in an ever widening surface area until the sole of the foot's arch area becomes involved in managing the loads generated. The skin under the arch area of the foot, for most individuals is the least robust and most sensitive compared to the foot's primary and secondary load-bearing areas. The sole of the foot's arch area is also the least capable of directly bearing loads generated during higher intensity gait-related activities. Random varied load-bearing stimulus to the sole of the foot's arch area triggers neuromuscular protective reflex activations that increase and stabilize the Keystone (apex) height of the dome-like arches thereby increasing the dome-like arches load-bearing capabilities (i.e., the loads become more focused under the primary load-bearing areas). Due to the sole of the foot's arch area sensitivity, significantly lower levels of stimulus intensity are required to trigger the neuromuscular protective reflex activations required to raise the arch apex and maintain the integrity of the dome-like arches sufficiently to ensure that the load-bearing forces are managed by the primary load-bearing areas. Optimal neuromuscular protective reflex activations occur when the stimulus to the sole of the foot's arch area is varied in intensity, the intensity is the lowest relative to the highest reflex activated arch apex and when the stimulus is randomly focused on small subtly varying locations during each step and from step to step. The less randomly localized and greater the surface area of stimulus' contact with the sole of the foot's arch area, the more muted the stimulus becomes and, the less effective the stimulus will be in triggering appropriate activity-related neuromuscular protective reflex dome-like arch activations. If the stimulus is spread over the total sole of the foot arch area, little or no appropriate neuromuscular protective reflex activations will occur. Repetitively unvaried and uniformly focused stimulus to the sole of the foot's arch area results in habituated maladaptive neuromuscular function. Trauma and compensatory maladapted neuromuscular function can occur, when load-bearing forces are repetitively focused at one small, or a few small, sole-of-the foot surface area locations within the primary load-bearing areas.

Different gait-related activities produce a variety of randomly located stimulus intensities to the sole of the foot's load-bearing areas and arch area which, in concert with proprioceptive sensory input, trigger corresponding neuromuscular protective reflex activations throughout the feet, legs, hips and back. For example walking uphill requires different muscle activations than walking on level ground. When walking barefoot on natural terrain such as grass, dirt, rock, etc. the sensory input to the sole of the foot varies each step in response to the variations of the terrain (i.e., the randomly localized pressures generated at the sole of the foot vary in size and positioning).

Neuromuscular protective reflex activations throughout the feet, legs, hips and back are observed when walking on flat man-made surfaces, uphill, or on varied natural terrain. In these instances, when the brain recognizes the terrain differences, it makes neural adaptations that send more activity to the muscles required to safely manage the forces generated. The rate of neural adaptation is affected by the area of the brain and by the intensity and similarity between sizes and shapes of previous stimuli.

When walking or running barefoot on varied natural terrain, the feet and the lower limb neuro-musculoskeletal systems naturally receive the random and varied sensory input and exercise they need to stay healthy, robust, and strong.

With repetitive, randomly varying stimulus, as seen when habitually walking barefoot on natural terrain, the neuro-musculoskeletal protective reflex mechanisms remain "alert". When habitually walking on flat man-made surfaces, the stimulus to the sole of the foot is essentially the same with each step (i.e., there are little to no variations in location, size and shape of stimulus), therefore, there is less challenge to the neuro-musculoskeletal systems and they lose some of their robustness.

With constant or repetitive (non-varied) stimulus the body adapts by tuning it out, and the related "tuned out" muscle activations become reflexive and habituated, thus (mal) adapted. In this situation, the protective reflex mechanisms become dormant relative to the degree of repetitive non-challenging activity.

When walking or running, while wearing conventional footwear (which is the norm), sensory input to the sole of the feet is both dampened due to force dissipation and unvaried in location, and the natural dynamic movements related to the neuro-musculoskeletal protective reflex activated dome-like arches are restricted. As a result, the feet and the lower limb neuro-musculoskeletal systems do not receive the random varied sensory input and exercise (movement) they require to stay healthy, robust, and strong.

It is well documented that the incidence of gait-related pathologies and symptoms, in countries whose inhabitants are largely unshod (i.e: barefoot), are a fraction of those seen in countries where it is commonplace to be shod. This discrepancy in incidence can be directly attributed to footwear and the apparent faults in the design of footwear.

Footwear has not always been detrimental to the wearer. The traditional moccasins, used by the North American aboriginal peoples, with their thin leather soles and soft flexible uppers, provide the random varied sensory input to the sole of the feet and allow the unrestricted dynamic movement required for optimal neuro-musculoskeletal function throughout the feet, legs, hips and back.

However, the supposedly more modern footwear designs, with their thicker and/or stiffer soles, restrictive uppers, cushioning and supportive properties, are now the conventional norm. The non-varied and dampened sensory input and the inability of the typical shoe to work in unison with the musculoskeletal mechanics of the foot can be seen as the greatest influencers of gait-related problems. Regular use of footwear that incorporates these influencers directly contributes to (mal)adaptive gait-related neuro-musculoskeletal function throughout the feet, legs, hips and back. In the vast majority of cases, those experiencing some form of gait-related pathology or symptom develop those pathologies or symptoms as a direct result of maladapted lower limb neuro-musculoskeletal function.

This is particularly true of footwear, insole, and orthotic devices that "support and or cushion the feet," and/or footwear that restricts the raising of the toes and arches or incorporates motion control features. With habitual use of footwear or devices that support, cushion, or restrict feet, the neuromuscular function throughout feet, legs, hips, and back will physically and functionally conform (maladapt) to these restrictive and less stimulating footwear environments. Over time, the musculoskeletal mechanics throughout feet, legs, hips, and back become increasingly dependent upon the supportive and cushioning devices while losing their inherent robustness (i.e., become weaker). This maladaptation is the leading cause of most foot-related problems.

In spite of the above noted maladaptive effects on gait-related neuro-musculoskeletal function, the conventional, and most common means of addressing the symptoms of gait-related pathologies and poor foot biomechanics has been the use of orthotics and other insole products that artificially support and/or cushion the foot. Recent research indicates that while these products may provide some temporary relief of symptoms they do not "correct" the problem and they do nothing to encourage appropriate neuro-musculoskeletal function. In addition, recent studies have shown that users of these products suffer more foot-related injuries than those who use nothing at all in their shoes.

It is well founded in medical research that the long-term support or bracing of the musculoskeletal structure will result in neuro-musculoskeletal system atrophy. Furthermore, the importance of maintaining neuro-muscular function and mobility is abundantly documented and the use of exercise/mobility regimes have become the norm. For this reason, regardless of the regardless of the neuro-musculoskeletal pathology being treated, virtually all musculoskeletal medical disciplines (except for foot care), commonly employ some form of rehabilitative therapy (i.e., exercise) to retrain or regain optimal neuro-musculoskeletal function to increase muscle strength and flexibility at the joints.

It is rather paradoxical therefore that the common methods (support and cushioning) used to treat gait-related symptoms arising from an atrophied neuro-musculoskeletal structure further perpetuate its weakening. It is not uncommon when employing these methods for the symptoms to be alleviated for the short term (during initial bracing) but then for the original symptoms or others linked to faulty neuro-musculoskeletal and weakened structure to again manifest themselves.

Conventional footwear, insoles, and orthotic devices inhibit natural healthy gait-related neuro-musculoskeletal lower limb function in a number of significant ways:

1. By providing cushioning under the sole of the foot. Footwear, insoles, and orthotic devices commonly use polyurethane foam, EVA foam, and gel-like materials to provide cushioning to the sole of the foot. When the sole of the foot is loaded by the body's weight and activity related forces, these materials compress causing the loading forces to be dissipated by the cushioning properties of the foam and spread over an increasingly larger sole of the foot surface area. In addition, cushioning isolates the sole of the foot from the subtle sensory variations of randomly localized intensity created by the differences in the texture of the terrain and the lower limb's management of the body's center of mass. The greater the loading forces, the greater the foam compression, the greater the cushioning, the greater the sole of the foot's surface area that bears the load-bearing forces, and the greater the loading force dissipation. The greater the sole of the foot's surface area that bears the load-bearing forces, the less varied the subtle sensory variations of randomly localized intensity (i.e., the dissipating stimulus is progressively spread equally over an enlarging sole of the foot surface area). As a result:
   a. the lower limb neuro-muscular systems do not receive the appropriate varied stimulus (multiple random locations and intensities) needed to trigger the activity appropriate protective reflex activations (nociceptive and proprioceptive related stimulus is dampened and or inhibited);
   b. the feet and lower limb become mechanically unstable due to inefficient musculoskeletal alignment and function, (i.e., insufficient height of reflex activated dome-like arch apices);
   c. dynamic force management and propulsion capabilities are compromised throughout the lower limbs, hips, and back; and
   d. maladaptive neuro-musculoskeletal function becomes conditioned (habituated).
2. By restricting the natural movement of the feet. During habitual barefoot gait, activity-related neuromuscular protective reflex activations cause the great toe and apex of the dome-like arches to dynamically rise and fall in unison in response to the intensity of the activity-related forces. The great toe and apex of the dome-like arches are synergistically related and both must rise in unison to stabilize the dome-like arches' load-bearing integrity. If the great toe is prevented from rising, the Keystone (apex) of the dome-like arches cannot stabilize. If the Keystone (apex) of the dome-like arches is prevented from rising to the height required to manage the load-bearing forces, the dome-like arches will become unstable and lose their mechanical load-bearing integrity.

The upper construction of a shoe with a shallow toe box and/or restrictions over the arch area (due to design, construction method, stiff materials and or tight lacing) restricts the dynamic raising of the apex of the dome-like arches and acts like a cast or splint on the feet, resulting in:
   a. the feet and lower limb becoming mechanically unstable due to inefficiently aligned bones, (i.e., insufficient height of reflex activated dome-like arch apices to mechanically manage loads—the foot over pronates as the arch flattens);
   b. foot and ankle joint stiffness and muscle atrophy;
   c. compromised dynamic force management and propulsion capabilities;
   d. inhibited nociceptive and proprioceptive reflex muscle activity; and
   e. maladaptive neuro-musculoskeletal function through out lower limbs, hips, and back.
3. By artificially supporting the soles of the feet. Arch supports or orthotics are commonly used address the symptoms (instability) created by poor neuromuscular foot function caused by cushioning and restrictive footwear. They artificially support, or prop up, the arches of the feet to prevent them from collapsing or falling due to gait-related load-bearing forces. However, while these devices may provide some temporary relief:
   a. they result in a greater sole of the foot surface area bearing the load-bearing forces,
   b. they create a less variable and more dampened load-bearing sensory stimulus [the lower limb neuromuscular systems do not receive the appropriate varied stimulus (at multiple random locations and intensities) needed to trigger the activity-appropriate protective reflex activations (nociceptive and proprioceptive related stimulus is dampened and or inhibited)];
   c. with prolonged use, the feet and lower limb become progressively weaker (atrophy) and increasingly dependent upon the artificial support, due to the fact that they are not challenged to manage the load-bearing forces;
   d. with prolonged use, foot and ankle joint stiffens, and muscles atrophy, due to the loss or restriction of dynamic movement;
   e. they compromise dynamic force management and propulsion capabilities; and
   f. they promote maladaptive neuro-musculoskeletal function throughout the entire lower limb, hips, and back.
4. By incorporating rigid orthotics, insoles, midsoles, and/or outsoles. Rigid orthotics, insoles, midsoles, and outsoles inhibit healthy natural gait-related neuromuscular dynamics and, further, rigid midsoles and outsoles significantly increase the forces that the feet must manage by up to 400%. They isolate the sole of the foot from the subtle sensory variations of localized intensity created by the differences in the texture of the terrain. As a result:

a. a greater sole-of-the-foot surface area bears the load-bearing forces,
b. they create a less variable, and more dampened, load-bearing sensory stimulus [the lower limb neuromuscular systems do not receive the appropriate varied stimulus (at multiple random locations and intensities) needed to trigger the activity-appropriate protective reflex activations (nociceptive and proprioceptive related stimulus is dampened and or inhibited)];
c. they compromise dynamic force management and propulsion capabilities; and
d. they promote maladaptive neuro-musculoskeletal function through out lower limbs, hips, and back.

In all instances, maladaptive neuro-musculoskeletal function and damaging degenerative stresses increase relative to the habitual use of footwear, insole or orthotics that incorporate cushioning, restrictive, supportive, and stiffness properties.

Over time, the footwear related maladaptive neuro-musculoskeletal function becomes the "dysfunctional norm" as it is conditioned or trained via desensitization, habituation, and adaptation. When this occurs, the feet and lower limb are incapable of effectively responding to the ever-changing environmental forces (i.e., become mechanically weaker). The resulting degenerative stresses cause or contribute to the majority of foot-related pathologies, not only in the feet but up throughout the kinetic chain. Common symptoms include pain, stiffness, and swelling in joints and other supporting structures of the body such as muscles, tendons, ligaments, and bones, along with muscle atrophy, muscle hypertropathy (overuse), tissue damage, fibrosis/scar tissue, and loss of bone density.

This dysfunctional maladaptive norm can only be reversed by:

a. altering or eliminating the footwear environment that facilitated the maladaptive neuromuscular function, and
b. employing rehabilitative therapies (exercise/conditioning) that retrain optimal neuro-musculoskeletal activity and promote "healthy" stressors.

Anything that touches the sole of the foot during gait-related load-bearing will create a stimulus to the sole of the foot, including supportive and cushioning products. However, the stimulus produced by any given product may, or may not, produce the randomized variable stimulus required for healthy optimal neuro-musculoskeletal function and such stimulus may in fact cause maladaptive neuro-musculoskeletal function.

Early patents and patent applications have proposed the use of an innersole device and shoe devices whose function is to create a proprioceptive, or internal feedback stimulus to a user's foot can directly target the underlying pathology or dysfunction. Such devices are disclosed in U.S. Patent Application Publication No. 20130312280 A1 by Gardiner, in U.S. Patent Application Publication No. 20130318818 A1 by Gardiner, in U.S. Pat. No. 5,404,659 to Burke et al, in U.S. Pat. No. 6,301,807 to Gardiner, in U.S. Pat. No. 6,732,547 to Gardiner, and in U.S. Pat. No. 7,100,307 to Burke et al.

U.S. Pat. Application Publication No. 20130312280 A1 discloses an insole device configuration with interchangeable proprioceptive reflex catalysts: having ellipsoidal or spherical shape; the apex of which is positionable to dynamically engage and stimulate the nerve endings in the skin of the sole at the anatomical apex of the sole surface of the arch of a wearer's foot; and being dimensioned to move dynamically in harmony with the said foot's natural movement as a means to ensure that the dorsal apex of the biofeedback catalysts always aligns with the anatomical apex of the foot's arch system. It further defines that the anatomical apex of the foot's arch system as the highest part of the mid-foot's boney structure when viewed from the mid-foot's medial to lateral aspect between the calcaneous bone (heel) and metatarsal heads (forefoot). The said proprioceptive reflex catalysts are disclosed as a resiliency sufficient to stimulate the body's natural neuromuscular proprioceptive protective reflex response However, it has been observed by those skilled in the art of therapeutic insole application and those having familiarity with the usage of a product as disclosed in U.S. Pat. Application Publication No. 20130312280 A1, that the while the device provides some beneficial gait-related neuro-musculoskeletal reflex response, the stimulus created is not as randomly varied in location and intensity as is necessary to trigger the optimal neuro-musculoskeletal protective reflex responses required during a variety of gait-related activities. It has been observed that the device's ellipsoidal or spherical shaped proprioceptive reflex catalysts always centralize the gait-related load-bearing forces at one location (the apex of the foot's arch systems) due to their convex top and bottom surfaces. It has been furthermore observed that, as a reflex catalyst compresses with increasing load-bearing forces, the reflex catalyst's top and bottom surfaces progressively deflect such that the upper surface area of a reflex catalyst spreads those forces uniformly across the sole surface of the arch of a wearer's foot. As a result, the more that the load-bearing forces compress a reflex catalyst, the greater those forces are dissipated as they are increasingly spread over the reflex catalyst's surface area. As a result the stimulus created by a respective reflex catalyst is progressively dissipated over a corresponding progressively larger centralized location at the sole of the foot. Furthermore, it has been observed that different stimulus intensities can only be created by interchanging a respective proprioceptive reflex catalyst with another comprised of different geometries or material densities.

U.S. Patent Application Publication No. 20130318818 A1 discloses a shoe midsole and insole device configurations with a sole shaped body defined by an upwardly extending dome in the midfoot area, with a biofeedback catalyst with an anchoring system within said dome, said catalysts being ellipsoidal or spherically shaped that dynamically roll and pivot about their plantar apices, as they mirror the foot's movement throughout multidimensional activities, as a means to always engage and stimulate the nerve endings in the skin of the sole at the anatomical apex of the foot's arch system. The said biofeedback catalysts are intended to stimulate the body's natural neuromuscular reflex mechanism that optimally align and stabilize the foot's musculoskeletal arch system and ankle. The anatomical apex of the foot's arch system is defined as the highest part of the mid-foot's honey structure when viewed from the mid-foot's medial to lateral aspect between the calcaneous (heel) and metatarsal heads (forefoot).

It has been observed, by those skilled in the art of therapeutic insole application, and those having familiarity with the usage of products as disclosed in U.S. Patent Application Publication No. 20130318818 A1 that while the devices provide some benefit, they fail to provide the optimal randomly varied stimulus required to trigger an adequate multidimensional gait-related neuro-musculoskeletal protective reflex response because the shoe midsole's or insole's upwardly extending dome upper surface always centralizes the stimulus created by a respective biofeedback catalyst at one location (the apex of the foot's arch systems). In addition, the device's upwardly extending dome upper surface causes a progressive dissipation of the load-bearing forces and related stimulus to the sole of the foot by spreading the forces uniformly over the plantar surface area of the foot that engages with the dome's upper surface. Furthermore, different stimulus intensities can only be created by interchanging a respective biofeedback catalyst with another comprised of different geometries or material densities.

U.S. Pat. No. 5,404,659 discloses an innersole and/or midsole configuration with an arch rehabilitation catalyst that stimulates the Golgi tendon organ, which in turn, stimulates the musculoskeletal structure of the foot. The catalyst is defined as a asymmetrically domed hump, which creates mild to strong discomfort to initially stimulate the Golgi tendon organ.

However, is has been found that the device disclosed in U.S. Pat. No. 5,404,659 does not function as described, and that the majority of users find the device too uncomfortable. In particular, the stimulus created is static, too intense, and limited to one centralized location. The catalyst disclosed does not compress when vertical forces are equal to the user's body weight and only compress when the vertical forces are in the range of 2.5 times the user's body weight. In effect, the catalyst functions as a mechanism that artificially supports the foot's arches and prevents the optimal natural dynamic raising and lowering of the apex of the user's arch system. The type of stimulus created by this device is clearly not beneficial to the user as it causes maladaptive stress inducing neuromuscular responses that cause pain, discomfort, and possible injury to the user. Evidence of this has been seen by those skilled in the art of therapeutic insole application and those having familiarity with the usage of a product as disclosed in U.S. Pat. No. 5,404,659.

U.S. Pat. No. 6,301,807 B1, U.S. Pat. No. 6,732,457 B2, and U.S. Pat. No. 7,100,307 B2 disclose insole and/or shoe midsole configurations with a dome-shaped catalyst with an apex for interfacing with an anatomical apex of the foot's arch system target area, said target area being the point of articulation of the lateral cuneiform, cuboid, and navicular bones of the foot, said catalyst displaying compression and rebound properties to permit uninhibited triplanar pivoting of said foot about said target area. These patents also disclose a cavity in the undersurface of the said dome-shaped catalyst that accommodates removable inserts that act as a means of controlling the resilient deformity of the said catalyst. The disclosed device configurations are intended to catalyze muscle group balancing by using the body's proprioceptive feedback mechanisms.

However, it has been observed, by those skilled in the art of therapeutic insole application and those having familiarity with the usage of products as disclosed in U.S. Pat. Nos. 6,301,807 B1 and 6,732,457 B2 and U.S. Pat. No. 7,100,307 B2, that while these products provide some benefit, they neither optimally catalyze muscle group balancing nor do they adequately catalyze the gait-related neuro-musculoskeletal reflex responses that are required to optimally stabilize the musculoskeletal alignment throughout the feet, legs, hips, and back during multidimensional activities; such that the activity-related musculoskeletal alignment is the most efficiently capable of managing those the forces generated from the perspectives of injury prevention, comfort, and performance enhancement. The dome catalyst's fixed location on the insole or shoe midsole combined with the design and materials in which the insole, shoe midsole, and inserts are manufactured, results in catalyst forces (created by the dome alone or with a respective insert) that are always centralized at one location (apex of the foot's arch systems). Furthermore, the shape and design of the dome catalyst causes the load-bearing forces and related stimulus intensities to be dissipated because they are uniformly spread over the sole of the foot surface area that interfaces with the dome's upper surface. Different stimulus intensities can only be created by interchanging a respective dome insert with another comprised of different geometries or material densities.

All of the devices disclosed in U.S. Patent Application Publication No. 20130312280 A1, in U.S. Patent Application Publication No. 20130318818 A1, U.S. Pat. No. 5,404,659, in U.S. Pat. No. 6,301,807, in U.S. Pat. No. 6,732,547, and in U.S. Pat. No. 7,100,307 feature a dome shaped catalyst with an apex that is intended to always interface with and stimulates the sole of the foot at a target area located at the anatomical apex of the foot's. They further identify the target area as being the point of articulation of the lateral cuneiform, cuboid, and navicular bones of the foot. However, it has been observed, by those skilled in the art of therapeutic insole application and those having familiarity with the usage of products as disclosed in U.S. Patent Application Publication No. 20130312280 A1, in U.S. Patent Application Publication No. 20130318818 A1, U.S. Pat. No. 5,404,659, in U.S. Pat. No. 6,301,807, in U.S. Pat. No. 6,732,547, and in U.S. Pat. No. 7,100,307 that the described target area (the point of articulation of the lateral cuneiform, cuboid, and navicular bones of the foot) is not the preferred or optimal target area and that when stimulus is repeatedly centralized at this area, or any one area, the neuro-muscular systems will become habituated to the stimulus and tune it out. Once the human body's neuro-muscular systems become habituated to a stimulus, the desired neuromuscular protective reflex mechanisms are no longer activated. The wearer of the devices, as disclosed, can only counter the habituation effect caused by repetitively stimulating the target area by progressively employing firmer catalyst and less resilient inserts as a means of increasing the stimulus intensity at the target area. However, over time, the neuro-muscular systems become habituated to every increase in stimulus intensity created by the progressively firmer catalyst inserts, to the point where the catalysts become arch supporting mechanisms, the insert stimulus becomes painful, or the forces created become harmful and cause injury to the user. Therefore, the described dome-shaped catalysts' fixed apex location on the inner sole or shoe midsole, are unable to provide (without modification) the subtle random stimulus locations and intensity variations during each step and from one step to another that are required to achieve optimal gait-related neuro-musculoskeletal protective reflex responses during multidirectional activities. Evidence of this has been seen by those skilled in the art of therapeutic insole application and those having familiarity with the usage of a product as disclosed in U.S. Patent Application Publication No. 20130312280 A1, in U.S. Patent Application Publication No. 20130318818 A1, U.S. Pat. No. 5,404,659, U.S. Pat. No. 6,301,807 B1, U.S. Pat. No. 6,732,457 B2, and U.S. Pat. No. 7,100,307 B2.

It has been proposed that providing a device to create a stimulus to the plantar surface of a foot will improve lower extremity function. Such devices are described in U.S. Pat. No. 4,674,203 A to Goller; in U.S. Pat. No. 4,694,831 A to Seltzer; in U.S. Pat. No. 4,760,655 A to Mauch; in U.S. Pat. No. 4,831,749 A to Tsai; in U.S. Pat. No. 4,841,647 A to Turucz; in U.S. Pat. No. 5,664,342 A to Buchsenschuss; in U.S. Pat. No. 6,082,024 A to Del Biondo; in U.S. Pat. No. 7,765,719 B2 to Nurse et al; and in U.S. Pat. No. 8,615,905 B1 to Szabo et al.

U.S. Pat. No. 4,674,203 A discloses part of shoe and/or innersole devices made from an elastic material with an upper surface comprised of a plurality of lugs which provide a good massaging action to the soles of the feet and elasticity for unloading of the joints along with improved aeration off the soles of the feet. The said lugs are covered by perforated leather which acts with the lugs to provide an additional air cushion effect, which assists the cushioning effect of the elastic material.

However, while the device disclosed U.S. Pat. No. 4,674,203 A may aerate a wearer's foot, it has been observed by those skilled in the art of therapeutic insole application and those having familiarity with neuro-musculoskeletal function that, from a neuromuscular function perspective the device acts to uniformly cushion the foot and that any perceived massaging action created is more related to the device's cushioning properties. It has been observed that the said cushioning properties of said device are created when the load-bearing forces at the sole of the foot compress the elastic lugs and the air in the space between the lugs and the leather upper surface. This compression causes the load-bearing forces and related stimulus intensities at the sole of the foot to dissipate as the forces are uniformly spread over an enlarging sole-of-the-foot surface area. As a result, the sole of the foot does not receive the subtle sensory variations of randomly localized intensity created during multidirectional activities that are required for optimal gait-related neuromuscular protective reflex function. The device has no provision for providing stimulus increases at random locations in relation to increased load-bearing forces at, or within, the primary, secondary, and arch load-bearing areas. As noted herein, when the sole of the foot is continuously cushioned and there is a dissipation of stimulus, the stimulus intensity at any specific location diminishes, and thus there is less challenge to the neuro-musculoskeletal systems and they lose some of their robustness. It has been further observed that, with constant or repetitive dissipating stimulus the body's neuro-muscular systems adapts to the dissipated stimulus it by tuning it out and the related "tuned out" muscle activations become reflexive and habituated (mal) adapted. In this situation the protective reflex mechanisms become dormant relative to the degree of repetitive non-challenging activity. Therefore, the device as disclosed fails to provide the optimal varied stimulus intensities required to trigger an adequate multidimensional gait-related neuro-musculoskeletal protective reflex response.

U.S. Pat. No. 4,674,203 A discloses footwear with an inner sole device comprised of an upwardly projecting raised flat foot support platform with foot stimulating, dome-shaped, spaced massage bumps. The object of said bumps is to provide acupressure bumps to, at least, twelve key meridians that affect body functions. Said bumps massage the underside of the foot, and generally provide the wearer with continuous stimulation of the soles of the feet, and have a beneficial effect on the leg and foot muscles and internal organs of the wearer, particularly as related to the enhancement of circulation in the lower extremities.

However, it has been found that the massaging action provided by the device disclosed in U.S. Pat. No. 4,674,203 A fails to provide the optimal varied stimulus required to trigger an adequate multidimensional gait-related neuro-musculoskeletal protective reflex response. The disclosed acupressure massage bumps' fixed locations are said to engage the underside of a wearer's foot to cause continuous stimulation of the sole of the foot at corresponding fixed locations. As a result, the sole of the foot does not receive the subtle sensory variations of randomly localized intensity created during multidirectional activities that are required for optimal gait-related neuromuscular protective reflex function. The device has no provision for providing stimulus increases at random locations in relation to increased load-bearing forces at, or within, the primary, secondary, and arch load-bearing areas. It has been observed, by those skilled in the art of therapeutic insole application and those having familiarity with neuro-musculoskeletal function that when the sole of the foot is continuously stimulated and there is no variation in the size and shape of stimulus at a respective location, there is less challenge to the neuro-musculoskeletal systems and they lose some of their robustness. It has been further observed that, with constant or repetitive (non-varied) stimulus the body's neuro-muscular systems become over stimulated and adapt to the over stimulation by tuning it out and the related "tuned out" muscle activations become reflexive and habituated (mal)adapted. In this situation the protective reflex mechanisms become dormant relative to the degree of repetitive non-challenging activity.

U.S. Pat. No. 4,760,655 A discloses an insole device comprised of an upper surface having a yielding base sole with an upper surface having reflex zones, said reflex zones having yielding cushions that align with the reflex zones of the sole of the foot. The sole of the foot reflex zones is disclosed as being precisely localized and limited areas that are specific to and connected to, via nerve strands, all organs and connective tissue structures such as spinal column and joints. It is disclosed that any massage of a foot's reflex zone triggers nerve impulses that are transmitted to the related organ or connective tissue structure, thereby promoting enhanced blood circulation and well-being and efficiency. It is further disclosed that the underlying aim of invention is to create an insole what more effectively massages the reflex zones by avoiding overstimulation.

However, it has been found that the massaging action provided by the device disclosed in U.S. Pat. No. 4,760,655 A fails to provide the optimal varied stimulus required to trigger an adequate multidimensional gait-related neuro-musculoskeletal protective reflex response. The said device is disclosed as having six specifically located reflex zones that are said to engage and massage the sole of wearer's foot at the corresponding sole-of-the-foot reflex zones. As a result, the sole of the foot does not receive the subtle sensory variations of randomly localized intensity created during multidirectional activities that are required for optimal gait-related neuromuscular protective reflex function. The device has no provision for providing stimulus increases at random locations in relation to increased load-bearing forces at, or within, the primary, secondary, and arch load-bearing areas. It has been observed, by those skilled in the art of therapeutic insole application and those having familiarity with neuro-musculoskeletal function that when the sole of the foot is continuously stimulated and there is no variation in the size and shape of stimulus at a respective location, there is less challenge to the neuro-musculoskeletal systems and they lose some of their robustness. It has been further observed that, with constant or repetitive (non-varied) stimulus the body's neuro-muscular systems adapts to the non-varied stimulation by tuning it out and the related "tuned out"

muscle activations become reflexive and habituated (mal) adapted. In this situation the protective reflex mechanisms become dormant relative to the degree of repetitive non-challenging activity.

U.S. Pat. No. 4,831,749 A discloses footwear with a ventilating and massaging insole having a plurality of upper beads that interface with the wearer's foot and a plurality of lower beads that interface with the shoe sole, so that upon load-bearing by a wearer's foot, the upper beads will be depressed to upwardly pump air through holes to ventilate and massage a wearer's foot.

However, while the device disclosed U.S. Pat. No. 4,831,749 A may ventilate a wearer's foot, it has been observed by those skilled in the art of therapeutic insole application and those having familiarity with neuro-musculoskeletal function that from a neuromuscular function perspective the device acts to uniformly cushion the foot and that any perceived massaging action created is more related to the devices' cushioning properties. The cushioning properties of said device are created when the loading forces at the sole of the foot compress the air contained in the upper and lower beads and forces the air through the holes in the insole, and from any mechanical resistance created by the compression of the beads relative to the material that they are made from. Furthermore, the multiplicity and dimensional uniformity of the beads cover the total surface area of the insole device, which cause the load-bearing forces and related stimulus intensities at the sole of the foot to dissipate as the forces are uniformly spread over an enlarging sole-of-the-foot surface area. As a result, the sole of the foot does not receive the subtle sensory variations of randomly localized intensity created during multidirectional activities that are required for optimal gait-related neuromuscular protective reflex function. The device has no provision for providing stimulus increases at random locations in relation to increased load-bearing forces at, or within, the primary, secondary, and arch load-bearing areas. As noted herein, when the sole of the foot is continuously cushioned and there is a dissipation of stimulus, the stimulus intensity, at a specific location diminishes, and thus there is less challenge to the neuro-musculoskeletal systems and they lose some of their robustness. It has been further observed that, with constant or repetitive dissipating stimulus the body's neuro-muscular systems adapts to the dissipated stimulus it by tuning it out and the related "tuned out" muscle activations become reflexive and habituated (mal)adapted. In this situation the protective reflex mechanisms become dormant relative to the degree of repetitive non-challenging activity. Therefore, the device disclosed fails to provide the optimal varied stimulus intensities required to trigger an adequate multidimensional gait-related neuro-musculoskeletal protective reflex response.

U.S. Pat. No. 4,841,647 A discloses an insole device comprised of an upper surface having upper protuberances which act to stimulate rhythmic acupressure massaging of the sole of a wearer's foot and act to simulate walking barefoot on uneven terrain. Said protuberances are located on the insole such that they engage important reflexology pressure point reflex zones. Said protuberances being relatively firm or rigid and being disposed on a resilient or spongy undersurface so that as the wearer walks, the protuberances will sink into the spongy undersurface as weight is placed on the foot and return to the original state as the foot is lifted and weight is removed. Acupressure massaging is defined as deep massaging that is capable of breaking up crystallized, globule deposits at the various strategic reflex zones and brings about a revitalization of the energy level of the person. The foot reflex zones are disclosed as being specific locations on the sole of a foot that are connected by nerves to various organs and muscles of the body.

However, it has been found that the messaging action provided by the device disclosed in U.S. Pat. No. 4,841,647 A fails to provide the optimal varied stimulus required to trigger an adequate multidimensional gait-related neuro-musculoskeletal protective reflex response. The said device is disclosed as having multiple specifically located reflex zones that are said to engage and massage the sole of wearer's foot at the corresponding sole of the foot reflex zones. The disclosed device is said to be comprised of an insole having a resilient base that is compressed by the load-bearing forces created at wearer's sole of the foot. The said protuberances being rigid relative to the base and which descend into the base in reaction to the load-bearing forces. It has been observed by those skilled in the art of therapeutic insole application and those having familiarity with neuro-musculoskeletal function that from a neuromuscular function perspective the device acts to progressively cushion the foot thereby dampening or muting the appropriate stimulus to the sole of the foot required to activate gait-related neuro-musculoskeletal protective reflex responses. This is because, as the protuberances descend into the base, and the base subsequently begins compressing, the respective load-bearing forces become progressively more evenly spread over the sole-of-the-foot surface area, and the load-bearing sole-of-the-foot surface area increases proportionally. Therefore, the stimulus to the sole of the foot becomes progressively dissipated and any perceived rhythmic massaging action to the sole of the foot is more related to the devices cushioning properties. As a result, the sole of the foot does not receive the subtle sensory variations of randomly localized intensity created during multidirectional activities that are required for optimal gait-related neuro-muscular protective reflex function. The device has no provision for providing stimulus increases at random locations in relation to increased load-bearing forces at, or within, the primary, secondary, and arch load-bearing areas. As noted herein, when the sole of the foot is continuously cushioned and there is a dissipation of stimulus, the stimulus intensity at a respective location diminishes, and thus creates less challenge to the neuro-musculoskeletal systems and they lose some of their robustness. It has been further observed that, with constant or repetitive dissipating stimulus the body's neuro-muscular systems adapts to the dissipated stimulus by tuning it out and the related "tuned out" muscle activation become reflexive and habituated (mal) adapted. In this situation the protective reflex mechanisms become dormant relative to the degree of repetitive non-challenging activity. Therefore, the device disclosed fails to provide the optimal varied stimulus intensities required to trigger an adequate multidimensional gait-related neuro-musculoskeletal protective reflex response.

U.S. Pat. No. 5,664,342 A discloses an insole having a plurality of profiles, in the shape of knobs, that are arranged in special areas on its upper surface. Said special areas correspond to reflex zones on the sole of the foot that correlate to certain internal organs. Said knobs, as disclosed, are to enable a massaging effect on the tissue of a foot. The purposeful arrangement of the knobs, within predetermined zones of the insole, has the effect that certain zones of the soles of a wearer are automatically being massaged while walking, and this effect in turn influences the organs corresponding to these zones. It is further disclosed that the knobs be made of a rubber-elastic material and be borne by a rubber-elastic layer with which they are formed.

However, it has been observed by those skilled in the art of therapeutic insole application and those having familiarity with neuro-musculoskeletal function and with the usage of products disclosed in U.S. Pat. No. 5,664,342 A fail to provide the optimal varied stimulus required to trigger an adequate multidimensional gait-related neuro-musculoskeletal protective reflex response. The said device's specifically located knobs engage and massage the sole of wearer's foot at fixed internal organ reflex locations and such locations are not relevant to gait-related neuro-musculoskeletal protective reflex activations. The stimulus caused by the said knobs to the sole of the foot during load-bearing is constant and unvaried in intensity and location during each step and from step to step. With increased load-bearing forces, the stimulus to the sole of the foot becomes progressively dissipated and any perceived rhythmic massaging action to the sole of the foot is more related to the devices cushioning properties. As a result, the sole of the foot does not receive the subtle sensory variations of randomly localized intensity created during multidirectional activities that are required for optimal gait-related neuromuscular protective reflex function. The device has no provision for providing stimulus increases at random locations in relation to increased load-bearing forces at, or within, the primary, secondary, and arch load-bearing areas. As noted herein, when the sole of the foot is continuously cushioned and there is a dissipation of stimulus, the stimulus intensity at a specific location diminishes, and thus there is less challenge to the neuro-musculoskeletal systems and they lose some of their robustness. It has been further observed that, with a constant or repetitive dissipating stimulus the body's neuro-muscular systems adapts to the dissipated stimulus it by tuning it out and the related "tuned out" muscle activations become reflexive and habituated (mal)adapted. In this situation, the protective reflex mechanisms become dormant relative to the degree of repetitive non-challenging activity.

U.S. Pat. No. 6,082,024 A discloses a sole for footwear comprised of a plurality of pressure-stimulation elements that move perpendicularly relative to the surface of the sole. Said pressure-stimulation elements are specifically located on the device to correspond with predetermined nerve centers in the sole of a foot. The disclosed device is said to bring about selective, repeatedly-exerted pressure stimulation, comparable to the impact of massage technique, at the predetermined nerve centers in the sole of the foot.

However, it has been observed by those skilled in the art of therapeutic insole application and those having familiarity with neuro-musculoskeletal function and with the usage of products disclosed in U.S. Pat. No. 6,082,024 A fail to provide the optimal varied stimulus required to trigger an adequate multidimensional gait-related neuro-musculoskeletal protective reflex response. The said device's specifically located pressure-stimulation elements engage and massage the sole of wearer's foot at fixed nerve center locations and such locations are not relevant to gait-related neuro-musculoskeletal protective reflex activations. It has been observed that the stimulus caused by the said pressure-stimulation elements to the sole of the foot during load-bearing is constant and unvaried in intensity and location during each step and from step to step. As a result, the sole of the foot does not receive the subtle sensory variations of randomly localized intensity created during multidirectional activities that are required for optimal gait-related neuromuscular protective reflex function. The device has no provision for providing stimulus increases at random locations in relation to increased load-bearing forces at, or within, the primary, secondary, and arch load-bearing areas. It has been observed that when the sole of the foot is continuously stimulated and there is no variation in the size and shape of stimulus at a respective location, there is less challenge to the neuro-musculoskeletal systems and they lose some of their robustness. It has been further observed that, with constant or repetitive (non-varied) stimulus the body's neuro-muscular systems adapt to the non-varied stimulation by tuning it out and the related "tuned out" muscle activations become reflexive and habituated (mal)adapted. In this situation the protective reflex mechanisms become dormant relative to the degree of repetitive non-challenging activity.

U.S. Pat. No. 7,765,719 discloses a footbed configuration for engaging a plantar surface of a wearer's foot with one of the lateral or medial sides having a smooth surface and the opposing side having a textured surface comprised of plural raised areas. Depending upon the location of the said textured surface and the type of activity, the altered sensory input to the plantar surface of a foot is said to affect (improve) the lower extremity kinematics.

However, it has been found that the stimulus provided by the devices disclosed in U.S. Pat. No. 7,765,719 fail to provide the optimal varied stimulus required to trigger an adequate multidimensional gait-related neuro-musculoskeletal protective reflex response because the stimulus is always fixed or centralized on one half of the plantar surface of the sole of the foot. In addition, the stimulus created by the respective textured and un-textured areas at the corresponding sole of the foot load-bearing surface areas is uniformly the same, at each of the respective sole-of-the-foot contact areas, during each step and from step to step. As a result, the sole of the foot does not receive the subtle sensory variations of randomly localized intensity created during multidirectional activities that are required for optimal gait-related neuromuscular protective reflex function. The device has no provision for providing stimulus increases at random locations in relation to increased load-bearing forces at, or within, the primary, secondary, and arch load-bearing areas. It has been observed, that when the sole of the foot is continuously stimulated and there is no variation in the size and shape of stimulus at a respective location, there is less challenge to the neuro-musculoskeletal systems and they lose some of their robustness. It has been further observed that, with constant or repetitive (non-varied) stimulus the body's neuro-muscular systems adapts to the non-varied stimulation by tuning it out and the related "tuned out" muscle activations become reflexive and habituated (mal)adapted. In this situation the protective reflex mechanisms become dormant relative to the degree of repetitive non-challenging activity.

U.S. Pat. No. 8,615,905 B1 discloses massaging footwear which enhances a user's overall wellbeing through functions of support, massaging, and reflexology. The disclosed device comprises a pair of footwear, each comprising an insole with a plurality of integral massaging pads. The location of said messaging pads correspond in location to popular reflexology charts. It is further disclosed that the device is comprised of foam layers as a means of providing cushioning to absorb compressive forces applied during normal walking.

However, it has been found that the messaging action provided by the device disclosed in U.S. Pat. No. 8,615,905 B1 fails to provide the optimal varied stimulus required to trigger an adequate multidimensional gait-related neuro-musculoskeletal protective reflex response. It has been observed by those skilled in the art of therapeutic insole application and those having familiarity with neuro-musculoskeletal function that from a neuromuscular function perspective the device acts to support and progressively cushion the foot thereby dampening or muting the appropriate stimulus to the sole of the foot required to activate gait-related neuro-musculoskeletal protective reflex responses. As the foam massaging pad layer compresses into the middle foam layer, during load-bearing, the load-bearing forces progressively compress the middle foam layer, causing the respective load-bearing forces at the sole of the foot to become progressively more evenly spread over an increasingly larger surface area. This causes the stimulus to the sole of the foot to progressively dissipate in relation to the devices cushioning properties and any perceived rhythmic massaging action to the sole of the foot is more related to these cushioning properties. As a result, the sole of the foot does not receive the subtle sensory variations of randomly localized intensity created during multidirectional activities that are required for optimal gait-related neuromuscular protective reflex function. The device has no provision for providing stimulus increases at random locations in relation to increased load-bearing forces at, or within, the primary, secondary, and arch load-bearing areas. As noted herein, when the sole of the foot is continuously cushioned and there is a dissipation of the stimulus intensity at a specific location, there is less challenge to the neuro-musculoskeletal systems and they lose some of their robustness. It has been further observed that, with constant or repetitive dissipating stimulus the body's neuro-muscular systems adapts to the dissipated stimulus by tuning it out and the related "tuned out" muscle activations become reflexive and habituated (mal)adapted. In this situation the protective reflex mechanisms become dormant relative to the degree of repetitive non-challenging activity.

In view of the aforementioned devices disclosed, the inventors recognized the inherent problems and observed that there was a need for a means to provide footwear and or insoles that enhance and optimize gait-related neuro-musculoskeletal protective reflex response during a wide variety of gait-related activities. Thus the object of the present invention is to solve the aforementioned problems.

SUMMARY OF THE INVENTION

It is an object of the present invention to provide to a wearer an article of footwear wherein the design, manufacture and geometric characteristics enhance and accentuate the natural neuro-musculoskeletal function throughout wearer's feet, leg, hips and back during the gait cycle. Such an article of footwear promises to be of immense value to all its wearers, providing benefits which are rehabilitative, preventive, and performance enhancing.

According to one aspect of the present invention, the article of footwear includes shoe midsoles, or insole devices, configured to fit the profile of the human foot, that promote the subtle varied and randomized load-bearing stimulation, of the sole of the foot's primary, secondary, and arch load-bearing areas, that is required to facilitate appropriate, healthy, gait-related neuro-musculoskeletal protective reflex responses throughout the lower limbs, hips, and back, relative to varied multidirectional activities and their related intensities. The sole of the foot's primary load-bearing area being defined as the forefoot metatarsal area and the heel (calcaneous) area. The sole of the foot's secondary load-bearing area being defined as the lateral aspect of the midfoot between the fifth metatarsal head and the calaneous. The sole of the foot's arch load-bearing area being defined as the arch area of the foot located between the defined primary heel and forefoot load-bearing areas and medial to the defined secondary load-bearing area.

Due to the nature and sensitive of the sole of the foot's load-bearing areas, one or more different variable stimulating mechanisms may be employed singularly or collectively. A more intense variable stimulating mechanism is preferred for the sole of the foot's primary optimal load-bearing areas located under the metatarsal heads and heel. A less intense variable stimulating mechanism is preferred for the sole of the foot's secondary load-bearing area located along the lateral aspect of the foot between the fifth metatarsal head and the heel. A significantly less intense variable stimulating mechanism is preferred for the sole of the foot's most sensitive and least optimal load-bearing area.

The shoe midsole or insole device may have one or more primary, secondary and or an arch variable stimulus mechanism(s) being located such that their upper surfaces interface with the plantar aspect of the wearer's foot at the corresponding sole of the foot's primary, secondary, and arch load-bearing areas. When the sole of the foot's load-bearing forces are borne by the device: the primary variable stimulus mechanism creates higher intensity randomized stimulus at the sole of the foot; the secondary variable stimulus mechanism creates a slightly less intense randomized stimulus at the sole of the foot; and the arch variable stimulus mechanism creates a more subtle and less intense randomized stimulus at the sole of the foot. The differing physical properties of the shoe midsole or insole device's primary, secondary, and arch variable stimulus mechanisms, result in random variable stimulus to the sole of the foot during gait-related activities.

The shoe midsole or insole device's primary, secondary, and arch variable stimulus mechanisms may be comprised of two bonded layers or three bonded layers. The two bonded layer configuration having a resilient upper initial stimulus layer and a less resilient stimulus-enhancing lower layer. The three bonded layer configuration having a resilient initial stimulus upper layer, a less resilient stimulus-enhancing middle layer, and a lower stimulus variability layer with a resiliency greater than that of the stimulus-enhancing layer.

The two and three bonded layer configurations having an upper initial stimulus layer being comprised of a medium density foam (such as an EVA or polyurethane foam) or thermoplastic elastomer (TPE) material with a Shore hardness between 30 A and 55 A, and have a plurality of equally or randomly spaced holes that pass through the entirety of the initial stimulus layer. The hole diameters being approximately 1 mm to 5 mm and spaced between 2 and 5 mm apart. The two and three bonded layer configurations having a stimulus enhancing layer that is located under the initial stimulus layer. The stimulus-enhancing layer being comprised of a medium to firm density thermoplastic elastomer (TPE) material with a resiliency less than that of the initial stimulus layer, with a plurality of equally spaced upwardly facing projections aligned perpendicular to the stimulus enhancing layer's upper surface and positioned such that the projections align and interface with the holes in the initial stimulus layer. The projections may be comprised of a variety of different shapes such as pins, domes, or spheres. The diameter of the projections being such that they match the diameter of the holes in the initial stimulus layer, and the height of the projections being such that, when the initial stimulus layer and the stimulus enhancing layer are bonded together the upper surface of the projections is recessed between 1 mm to 5 mm below the upper surface of the initial stimulus layer. The three bonded layer configuration having a stimulus variability layer located under, and bonded to, the stimulus enhancing layer. The stimulus variability layer being comprised of a medium density foam material, (such as an EVA or polyurethane foam), or (TPE) material with a resiliency greater than that of the stimulus-enhancing layer. The two and three bonded layer configurations may have a top sheet, made from a thin fabric or leather material, bonded to the upper surface of the initial stimulus layer. By altering the material characteristics of the top sheet and the various stimulus layers: by using different materials or material resiliencies, by varying the thickness of the layers; by modifying the height, size, and shape of the stimulus-enhancing layer's projections, and by modifying the geometry of the projections' corresponding holes in the initial stimulus layer; a wide range of variable stimulation characteristics can be created to meet the specific requirements of a wide range of gait-related activities and different foot types.

When the varying intensities of sole of the foot's localized load-bearing forces are randomly focused on the initial stimulus layer, the layer's greater resiliency causes deeper compressions at locations where the sole of the foot's load-bearing forces are the greatest relative to a multidirectional activity. As these randomly located load-bearing forces diminish, the resiliency properties of the initial stimulus layer causes the compressed location to rebound back to its original shape. Higher randomly localized load-bearing forces will cause relatively deeper compressions at corresponding initial stimulus layer locations. When the initial stimulus layer's randomly localized load-bearing compressions are sufficiently deep enough, the sole of the foot contacts the upper surface of the stimulus enhancing layer projections. As a result, at least two levels of stimulus intensity are created at the randomly localized area. The first level being the milder stimulus created by the initial compression of the initial stimulus layer. The second level being a more localized and progressively more intense stimulus that is created when the sole of the foot contacts the stimulus enhancing layer projections; as the less resilient stimulus enhancing layer projections resist compression at a greater rate compared to the more resilient initial stimulus layer that continues to compress. If the device has a stimulus variability layer, a third level of stimulus is created by the stimulus variability layer's greater resiliency compared to the stimulus enhancing layer. The third level of stimulus is created when the sole of the foot's load-bearing forces on the less resilient stimulus-enhancing layer projections are sufficient to cause a localized deflection or compression in the more resilient stimulus enhancing layer, thereby, slowing the progression of the localized stimulus intensity to the sole of the foot As the load-bearing forces diminish, the stimulus enhancing, and stimulus variability layers, rebound to their original shapes.

The shoe midsole or insole device's primary, secondary, and arch variable stimulus mechanisms' varied compression characteristics ensure that the load-bearing stimulus at the sole of the foot varies, both in location and intensity, in response to an increase or decrease in the randomly located multi-directional load-bearing forces. As a result, the body's neuro-musculoskeletal systems receive the appropriate stimulus required to trigger an optimal protective reflex response throughout the lower limbs, hips and back, during each step and from step to step relative to the gait-related, activity-loading forces generated.

The shoe midsole or insole device's may have an arch specific variable stimulus mechanism comprised of a resilient symmetrical or asymmetrical dome-shaped catalyst with an apex positioned such that it interfaces with the anatomical apex of the foot's domed-shaped arches. The anatomical apex of the foot's dome-shaped arches being defined as the point of articulation of the medial cuneiform and navicular bones of the foot. The upper surface of the dome-shaped catalyst may be comprised of different materials, shapes, and sizes and present to the arch area of the foot as defined herein. The resilient catalysts display physical properties as to create subtle variable stimulus intensities at random locations to the sole of the foot, within the sole of the foot's arch area.

The manufacturing and assembly of any of the above of configurations may include snapping the upper layer and lower layer together, over-molding the upper and lower layer, and or using an adhesive to bond the layers and top sheet material together.

The arch variable stimulus mechanism's catalysts may have bottom surface that contacts the device's supporting surface or, the catalysts may have a bottom surface that does not contact the device's supporting surface.

The shoe midsole or insole device displays physical properties such that they do not provide functional bracing or support to the sole of the foot's arch area.

The shoe midsole or insole devices' primary, secondary, and arch variable stimulus mechanisms collectively and or individually ensure that the sole of the foot receives the optimal varied stimulus at random locations as are required to activate the body's protective reflex mechanisms during varied gait-related activities. The net result is more efficient and capable neuro-musculoskeletal function throughout the lower limbs, hips, and back. With regular use, the appropriately stimulated gait-related neuro-musculoskeletal systems are sufficiently challenged as to enhance their robustness and functional capabilities while reducing susceptibility to injury. Therefore, the shoe midsole, or insole device, provides rehabilitative, preventive and performance enhancing properties and/or capabilities.

BRIEF DESCRIPTION OF THE DRAWINGS

Preferred embodiments of the invention are illustrated below with reference to the accompanying illustrations.

FIG. 1 is a top plan view of the present invention showing the positioning of the variable stimulus mechanisms;

FIG. 2 *b* is a view of a variable stimulus mechanism embodiment showing the separate layers at the section line of b-b of FIG. 1*a;*

FIG. 2 *c* is the assembled view of a two layer variable stimulus mechanism embodiment as shown in FIG. 2*c;*

FIG. 2 *d* is an assembled view of a three layer variable stimulus mechanism embodiment as shown in FIG. 2*c;*

FIG. 2 *e* is an enlarged section view of the assembled three layer variable stimulus mechanism embodiment shown in FIG. 2*d*, without load-bearing forces applied;

FIG. 2 *f* is an enlarged section view of the assembled three layer variable stimulus mechanism embodiment shown in FIG. 2*d*, showing the compression characteristic with load-bearing forces applied;

FIG. 2 *g* is a view of an alternate variable stimulus mechanism embodiment showing the separate layers at the section line of g-g of FIG. 1*a;*

FIG. 2 *h* is the assembled view of a two layer variable stimulus mechanism embodiment as shown in FIG. 2*g;*

FIG. 2 *i* is an assembled view of a three layer variable stimulus mechanism embodiment as shown in FIG. 2*g;*

FIG. 2 *j* is an enlarged section view of the assembled three layer variable stimulus mechanism embodiment shown in FIG. 2*i*, without load-bearing forces applied;

FIG. 2 *k* is an enlarged view of the assembled three layer variable stimulus mechanism embodiment shown in FIG. 2*i*, showing the compression characteristics when load-bearing forces are applied;

FIG. 2 *l* is a view of an alternate variable stimulus mechanism embodiment showing the separate layers at the section line of l-l of FIG. 1*a;*

FIG. 2 *m* is an assembled view of a three layer variable stimulus mechanism embodiment as shown in FIG. 2*l;*

FIG. 2 *n* is an enlarged section view of the assembled three layer variable stimulus mechanism embodiment shown in FIG. 2*m*, without load-bearing forces applied;

FIG. 2 *o* is an enlarged view of the assembled three layer variable stimulus mechanism embodiment shown in FIG. 2*m*, showing the compression characteristics when load-bearing forces are applied;

FIG. 2 *p* is an enlarged view of the top plan view of the variable stimulus mechanism embodiment shown in FIG. 2*a;*

FIG. 3 *b* is the section line of b-b of FIG. 3*a;*

FIG. 3 *c* is the section line of c-c of FIG. 3*a;*

FIG. 4 *b* is the section line of b-b of FIG. 4*a;*

FIG. 4 *c* is the section line of c-c of FIG. 4*a,*

FIG. 5 *b* is the section line of b-b of FIG. 5*a;*

FIG. 5 *c* is the section line of c-c of FIG. 5*a;*

FIG. 6 *b* is the section line of b-b of FIG. 6*a;*

FIG. 6 *c* is the section line of c-c of FIG. 6*a;*

FIG. 7 *b* is the section line of b-b of FIG. 7*a;*

FIG. 7 *c* is the section line of c-c of FIG. 7*a;*

FIG. 8 is a top plan view of a fifth embodiment of the domed-shaped catalyst without a top membrane;

FIG. 9 is a top plan view of a sixth embodiment of the domed-shaped catalyst with a top membrane;

FIG. 10 is a top plan view of a seventh embodiment of the domed-shaped catalyst without a top membrane;

FIG. 11 is a top plan view of an eighth embodiment of the domed-shaped catalyst with a top membrane;

FIG. 12 is a top plan view of a ninth embodiment of the domed-shaped catalyst without a top membrane;

FIG. 13 is a top plan view of a ten embodiment of the domed-shaped catalyst with a top membrane;

FIG. 14 is a top plan view of an eleventh embodiment of the domed-shaped catalyst with a top membrane;

FIG. 15 *b* is the section line of b-b of FIG. 15*a*; and

FIG. 15 *c* is the section line of c-c of FIG. 15*a*.

DETAILED DESCRIPTION OF THE INVENTION

Figures 2B, 2C, 2D, 2E, 2F, 2G, 2H, 2I, 2J, 2K, 2L, 2M, 2N, 2O:
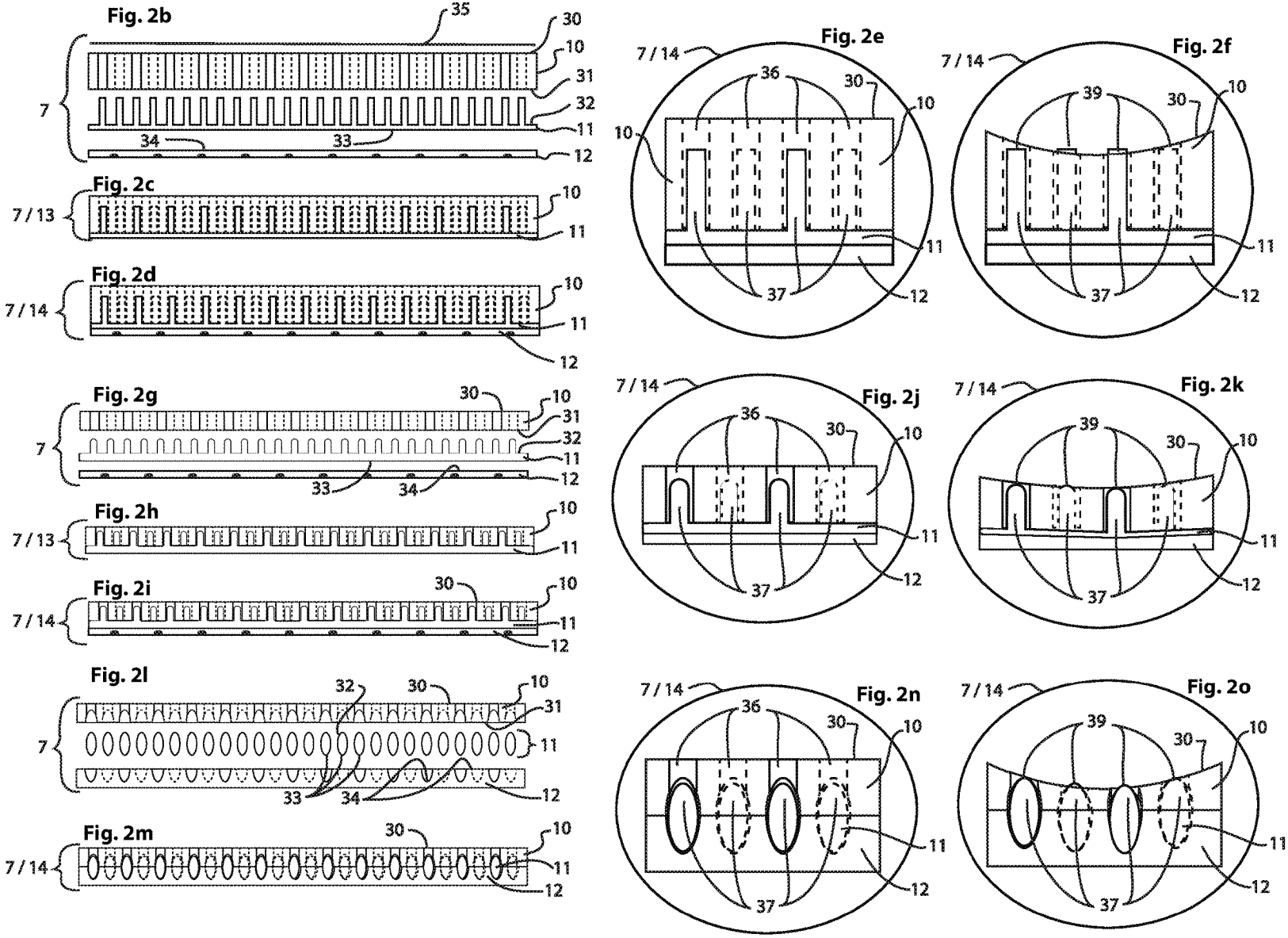
FIG. 2 *a* is a top plan view of a first embodiment of the present invention, with variable stimulus mechanisms in positions 2, 3, and 4.

A random variable stimulus insole or footwear device is generally illustrated by reference 1 in the Figures. The insole or footwear device 1 having an upper portion consisting of one or more variable stimulus mechanisms 7, and 8 located at one or more load-bearing areas 2, 3, 4 and 5 for interfacing with the plantar aspect of a human foot's load-bearing areas.

The insole or footwear device 1 having an upper portion consisting of a variable stimulus mechanisms 7 located at load-bearing area 5 consists of a flexible insole body or flexible shoe midsole having an upwardly extending dome 41 located central to the foot's anatomical keystone. The anatomical keystone being defined as intermediate cuneiform bone of the foot. The dome 41 having an apex 42 on the dorsal surface for aligning with the plantar aspect of a human foot at the anatomical keystone.

The variable stimulus mechanisms 7 may be comprised of two bonded layers or three bonded layers.

The two layer configuration 13 having a flexible resiliently deformable upper initial stimulus layer 10 and underneath the initial stimulus layer 10 a flexible less resiliently deformable stimulus enhancing layer 11. The three layer configuration 14 having a flexible resiliently deformable upper initial stimulus upper layer 10, a flexible less resiliently deformable stimulus enhancing middle layer 11, and a lower stimulus variability layer 12 with a flexible deformable resiliently greater than that of the stimulus enhancing layer 11. The bottom surface 31 of the initial stimulus layer 10 may be bonded to the upper surface 32 of the stimulus enhancing lower layer 11 in the two layer configuration 13 and three layer configuration 14. The bottom surface 33 of the stimulus enhancing layer 11 may be bonded to the upper surface 34 of the stimulus variability layer 12 in the three layer configuration 14. The two layer configuration 13 and three layer configuration may also have a top sheet 35 made of a fabric, textile or leather that is bonded to the upper surface 30 of the initial stimulus layer 10.

The upper initial stimulus layer 10 may be comprised of a medium density foam (such as an EVA or polyurethane foam) or thermoplastic elastomer (TPE) material with a Shore hardness between 30 A and 55 A, and have a plurality of equally or randomly spaced holes 36 that pass through the entirety of the initial stimulus layer 10. The diameters of the holes 36 being approximately 1 mm to 5 mm and spaced between 2 mm and 10 mm apart.

The stimulus enhancing layer 11 may be comprised of a medium to firm density thermoplastic elastomer (TPE) material with a resiliency less than that of the initial stimulus layer, with a plurality of equally spaced upwardly facing projections 37 aligned perpendicular to the upper surface 30 of the stimulus enhancing layer 10 and positioned such that the projections 37 align and interface with the holes 36 in the initial stimulus layer. The projections 37 may be comprised of a variety of different shapes such as pins, domes, or spheres. The diameter of the projections 37 being such that they match the diameter of the holes 36 in the initial stimulus layer 10, and the height of the projections 37 being such that, when the initial stimulus layer 10 and the stimulus enhancing layer 11 are bonded together the upper surface 39 of the projections 37 is recessed between 1 mm to 5 mm below the upper surface 30 of the initial stimulus layer 10.

The stimulus variability layer 12 may be comprised of a medium density foam material, (such as an EVA or polyurethane foam), or (TPE) material with a resiliency that is greater than that of the stimulus enhancing layer 11. The top surface 34 of the stimulus variability layer 12 may have a plurality of cavities 40 to receive the bottom surface 33 stimulus enhancing layer 11 projections 37.

The initial stimulus layer 10, stimulus enhancing layer 11, and the stimulus variability layer 13 act in concert to provide randomly localized variable stimulus to the sole of the foot in response to the randomly localized vertical load-bearing forces created at the sole of the foot during gait-related activities.

For example, when the varying intensities of sole of the foot's localized load-bearing forces are randomly focused on the initial stimulus layer 10, the initial stimulus layer's 10 greater resiliency results in deeper compressions of the initial stimulus layer's 10 upper surface 30, at locations where the sole of the foot's load-bearing forces are the greatest relative to a multidirectional activity. As these randomly located load-bearing forces diminish, the resiliency properties, of the initial stimulus layer 10 material, causes the initial stimulus layer's 10 upper surface 30 compressed locations to rebound back to their original shape. Higher randomly localized load-bearing forces will cause relatively deeper compressions at corresponding initial stimulus layer's 10 upper surface 30 locations. When the initial stimulus layer's 10 upper surface 30 randomly localized load-bearing compressions are sufficiently deep enough, the sole of the foot contacts the upper surface 39 of the stimulus enhancing layer 11 projections 37. As a result, at least two levels of stimulus intensity are created at the randomly localized area. The first level being the milder stimulus created by the initial localized compression of the initial stimulus layer 10 upper surface 30. The second level being a more localized and progressively more intense stimulus that is created when the sole of the foot contacts the stimulus enhancing layer 11 projections 37; as the less resilient stimulus enhancing layer 11 projections 37 resist compression at a greater rate compared to the more resilient initial stimulus layer 10, which continues to compress. When the device has three layer configuration 14, a third level of stimulus is created by the stimulus variability layer's 12 greater resiliency compared to the stimulus enhancing layer 11. The third level of stimulus is created when the sole of the foot's load-bearing forces, have locally compressed the upper surface 30 of the initial stimulus layer 10, to the point where the load-bearing forces are directly pressing on the upper surface 39 of the less resilient stimulus enhancing layer 11 projections 37. When these localized pressures on the upper surface 39 of the less resilient stimulus enhancing layer 11 projections 37 is sufficient, the pressures are transferred through the projections 37 and cause a corresponding localized deflection or compression in the upper surface 34 of the more resilient stimulus enhancing layer 12, thereby, slowing the progression of the localized stimulus intensity to the sole of the foot. As the sole of the foot's localized load-bearing forces diminish the initial stimulus layer 10, stimulus enhancing layer 11, and stimulus variability layer 12 rebound back to their original shapes.

The top sheet 35 may be comprised of a variety of materials such as leathers, artificial leathers, natural fabrics, synthetic fabrics or other textiles with different flexibilities and in different thicknesses.

The various stimulus layers 10, 11, and 12 may be comprised of a variety of materials, densities, resiliencies, and flexibilities such as foams, rubbers, plastics, or other flexible materials. The various stimulus layers 10, 11, and 12, may be comprised of varied thicknesses. The stimulus enhancing layer projections 37 and corresponding holes 36 in the initial stimulus layer 10 may be comprised of different heights, sizes, shapes, and spacing. By varying the materials and geometric characteristics of the various stimulus layers 10, 11, and 12, that comprise a variable stimulus mechanism 7, a wide range of variable stimulation characteristics may be created to meet the specific requirements of a wide range of gait-related activities, different foot types, and body weights.

The insole or footwear device 1 having an upper portion consisting of a variable stimulus mechanism 8 located at load-bearing area 5 consists of a flexible insole body or flexible shoe midsole having an upwardly extending dome-shaped reflex catalyst 43 located central to the foot's anatomical keystone. The reflex catalyst 43 having an apex 42 on the dorsal surface 48 for aligning with the plantar aspect of a human foot at the anatomical keystone.

The reflex catalyst 43 may have a plurality of equally or randomly spaced holes 44, that pass through the entirety of the reflex catalyst 43, that are formed by resiliently deformable vertical walls 46; or the reflex catalyst 43 may have a plurality a of equally or randomly spaced holes cavities 45, that extend upwards from the reflex catalyst 43 plantar surface 47, that are formed by resiliently deformable vertical walls 46.

The resiliently deformable vertical walls 46 may consist of different thicknesses or tapered such that the wall thickness is thinner at the plantar surface 47 than at the dorsal surface 48. The holes 44 or cavities 45 may consist of different shapes. A wide range of variable stimulus mechanism 8 characteristics may be achieved by varying the wall 46 thicknesses and the hole 44 or cavity 45 geometries, as may be required for different gait-related activities and foot types.

The plantar surface 47 of the reflex catalyst 43 may contact the insole or footwear device's 1 supporting surface 60, or the plantar surface 47 may not contact the insole or footwear device's 1 supporting surface 60. The supporting surface 60 being defined as the surface that the device rests on; for an insole device the supporting surface is the shoe midsole, for a shoe midsole device the supporting surface is the ground.

If the plantar surface 47 of the reflex catalyst 43 contacts the supporting surface 60, it is preferred that the reflex catalyst 43 be injection molded out of a molded rubber, thermoplastic rubber (TPR), or thermoplastic elastomer (TPE) materials with a Shore hardness between 5 A and 25 A. If the reflex catalyst 43 does not contact the supporting surface 60, the reflex catalyst 43 may be comprised of a variety of materials, densities, and resiliencies such as foams, rubbers, plastics or other flexible materials with a Shore hardness between 20 A and 55 A.

The reflex catalyst 43 is resiliently deformable to apply subtle randomly located and varied upwardly directed pressures to the skin of the sole of the foot in response to localized downward pressure on the reflex catalyst 43 by the foot. For example, the reflex catalyst 43 may provide progressively increased or decreased compressive resistance, at one or more locations, at changing locations, and at expanding or contracting location surface areas across the reflex catalyst's 43 dorsal surface 48; relative to the localized reflex catalyst's 43 dorsal surface 48 area expansion and contraction deformation and the degree of vertical deformation.

The reflex catalysts 43 may be bonded to the insole or footwear device 1 or the insole or footwear device 1 may incorporate a cooperating engagement means for securing the reflex catalysts 43 insole or footwear device 1.

FIG. 2 *a* illustrates an embodiment of an insole or footwear device 1 having an upper portion consisting of variable stimulus mechanisms 7, located at load-bearing areas 2, 3, and 4.

FIG. 2 *b* illustrates an exploded cross section view of an embodiment of the variable stimulus mechanism's 7, showing the initial stimulus layer 10, the stimulus enhancing layer 11, the stimulus variability layer 12, and top sheet 35. FIG. 2 *p* illustrate an exploded top view of the an embodiment of the variable stimulus mechanism's 7, showing the initial stimulus layer 10 holes 36 and the stimulus enhancing layer 11 projections 39. FIG. 2 *c* illustrates the variable stimulus mechanism's 7 two layer configuration 13. FIG. 2 *d* illustrates the variable stimulus mechanism's 7 three layer configuration 14. FIG. 2 *e* illustrates an exploded view of the variable stimulus mechanism's 7 three layer configuration 14. FIG. 2 *f* illustrates an exploded view of the variable stimulus mechanism's 7 three layer configuration 14, showing the deflection caused by the sole of the foot's localized loading forces. The embodiment illustrated may incorporate any of the variable stimulus mechanism's 7 configurations shown in FIG. 2 *c, d, h, i,* and *m* at any of the load-bearing area locations 2, 3, and 4 shown in FIG. 1.

FIGS. 2 *g, h, i, j*, and *k* illustrate an alternative embodiment of a variable stimulus mechanism's 7 two layer configuration 13 and three layer configuration 14, with FIG. 2 *k* showing the deflection caused by the sole of the foot's localized loading forces.

FIGS. 2 *l, m, n*, and *o* illustrate an alternative embodiment of a variable stimulus mechanism's 7 three layer configuration 14, with FIG. 2 *o* showing the deflection caused by the sole of the foot's localized loading forces.

Figure 3B:
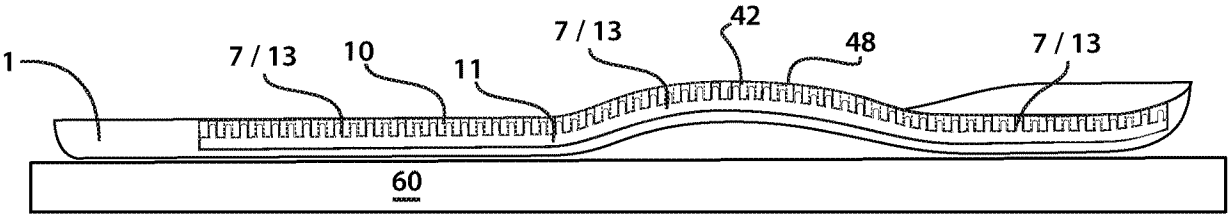
FIG. 3 *a* is a top plan view of a second embodiment of the present invention, with variable stimulus mechanisms in positions 2, 3, 4, and 5.
Figure 3C:
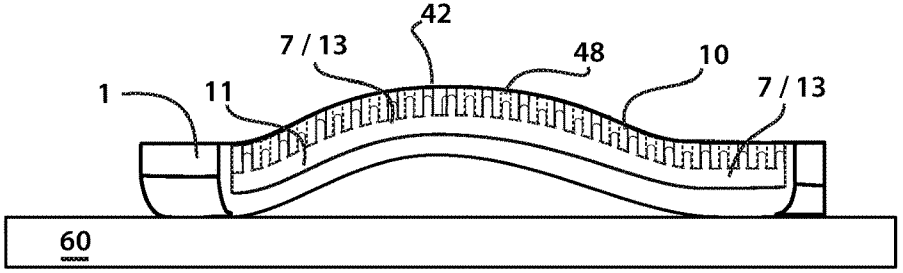
Figure 3A:
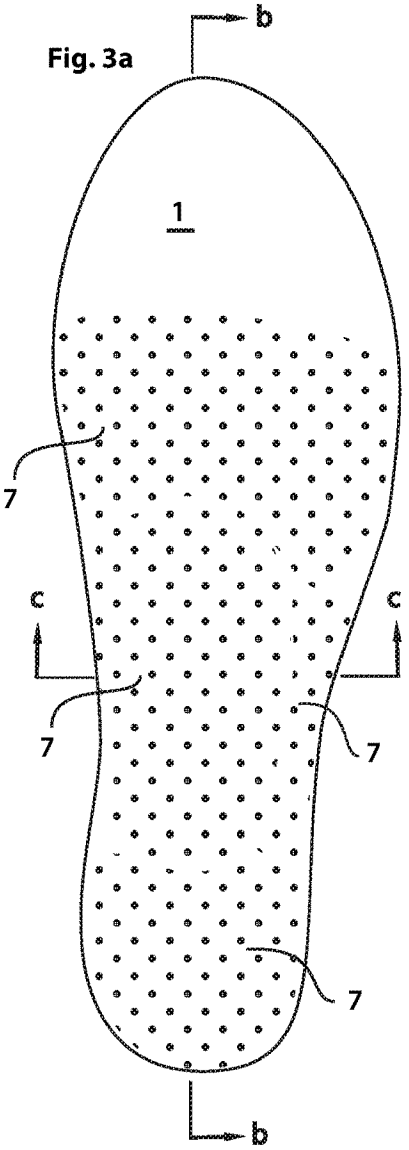

FIGS. 3 *a, b*, and *c* illustrate an alternative embodiment of an insole or footwear device 1 having an upper portion consisting of variable stimulus mechanisms 7, located at the load-bearing areas 2, 3, 4, and 5 shown in FIG. 1.

FIGS. 3 *b* and *c* illustrate the variable stimulus mechanism's 7 upwardly extending dome 41 located central to the foot's anatomical Keystone. The anatomical keystone being defined as intermediate cuneiform bone of the foot. The dome 41 having an apex 42 on the dorsal surface for aligning with the plantar aspect of a human foot at the anatomical Keystone. The embodiment illustrated incorporates the variable stimulus mechanism configuration shown in FIG. 2 *h* at all of the load-bearing area locations 2, 3, 4, and 5 shown in FIG. 1, and a one piece upper surface that creates the initial stimulus layers 10 at each of the respective variable stimulus mechanism's 7 locations. By varying the materials and or the geometries of the respective stimulus enhancing layers 11 at each of the load-bearing area locations 2, 3, 4, and 5 shown in FIG. 1, appropriate stimulus intensities may be created at each of the sole of the foot's load-bearing areas. The embodiment illustrated may incorporate any of the variable stimulus mechanism's 7 configurations shown in FIG. 2 *c, d, h, i*, and *m* at any of the load-bearing area locations 2, 3, 4, and 5 shown in FIG. 1.

Figure 4B:
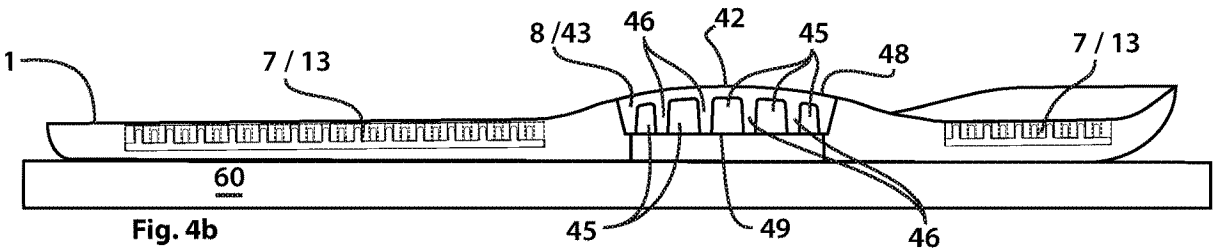
FIG. 4 *a* is a top plan view of a third embodiment of the present invention, with variable stimulus mechanisms in positions 2, 3, 4, and 5, with the domed-shaped catalyst in position 5 with a top membrane.
Figure 4C:
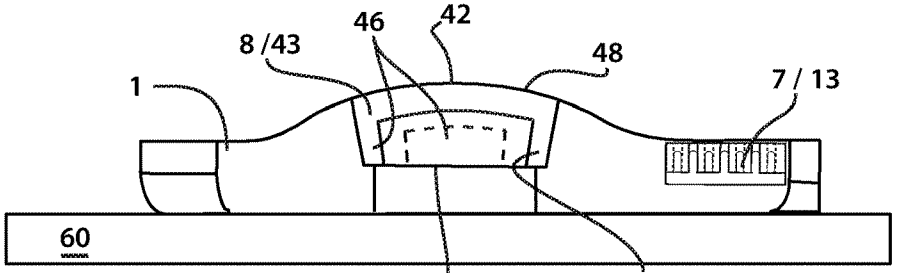
Figure 4A:
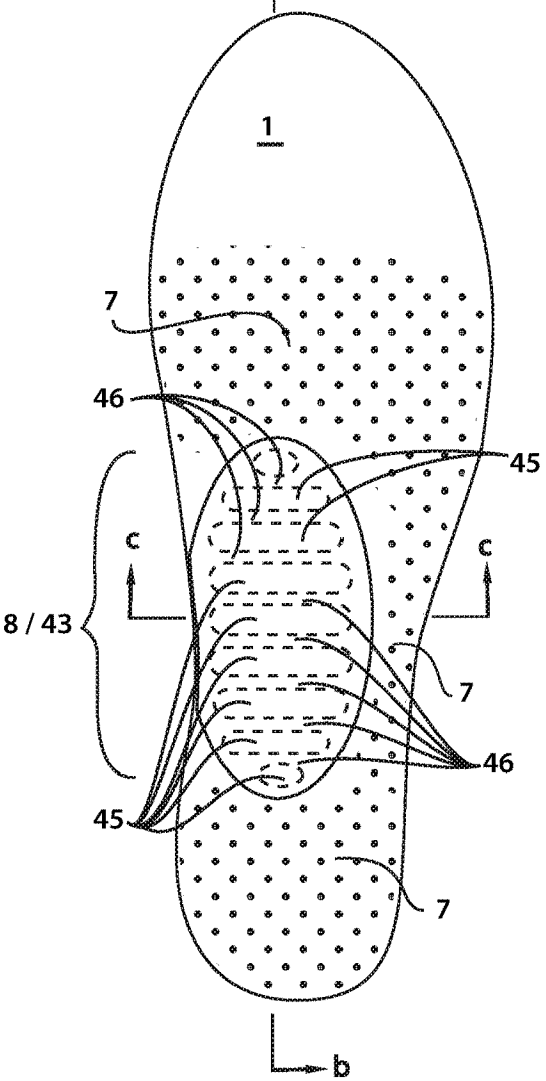
Figure 5B:
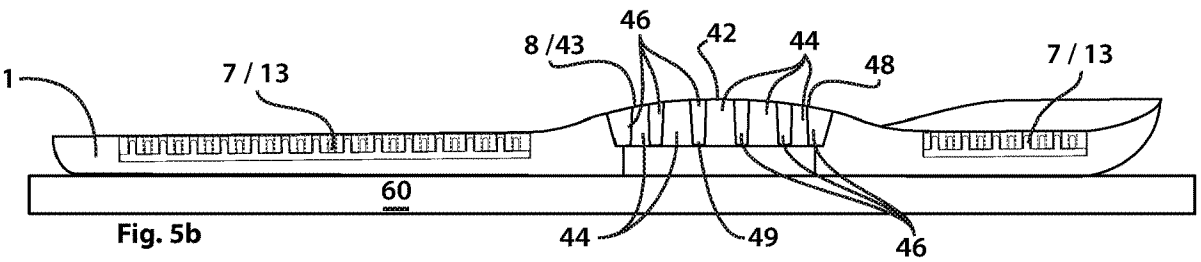
FIG. 5 *a* is a top plan view of a third embodiment of the present invention, with variable stimulus mechanisms in positions 2, 3, 4, and 5, with a second embodiment of the domed-shaped catalyst in position 5.
Figure 5C:
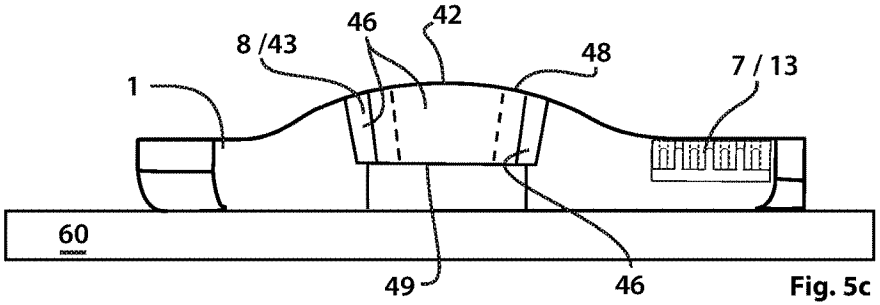
Figure 5A:
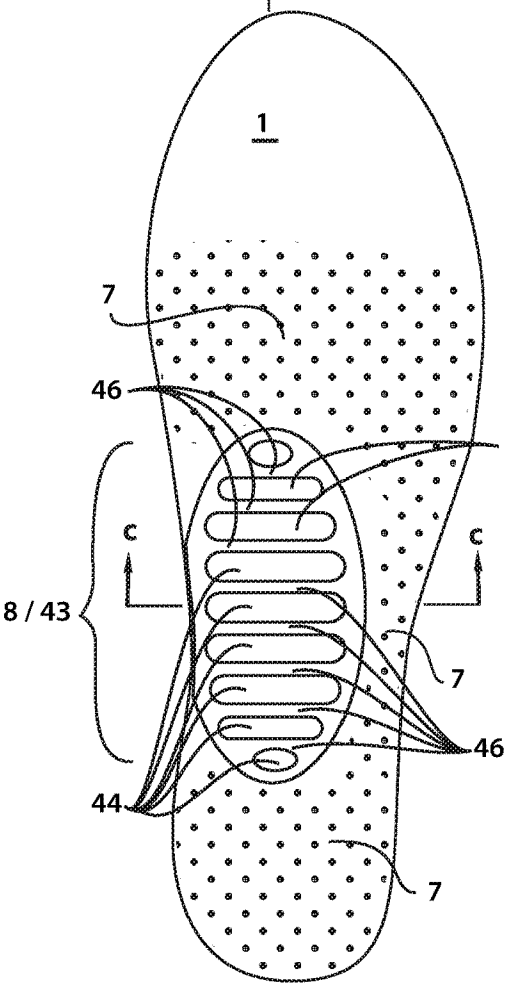

FIGS. 4 *a, b*, and *c* illustrate an alternative embodiment of an insole or shoe midsole device 1 having an upper portion consisting of variable stimulus mechanisms 7, located at the load-bearing areas 2, 3, and 4 shown in FIG. 1, and variable stimulus mechanism 8 located at the load-bearing area 5 shown in FIG. 1. The embodiment illustrated may incorporate any of the variable stimulus mechanism's 7 configurations shown in FIG. 2 *c, d, h, i*, and *m* at any of the load-bearing area locations 2, 3, and 4 shown in FIG. 1. FIGS. 4 *b* and *c* illustrate the variable stimulus mechanism's 8 upwardly reflex catalyst 43 located central to the foot's anatomical Keystone. The anatomical keystone being defined as intermediate cuneiform bone of the foot. The dome 43 having an apex 42 on the dorsal surface for aligning with the plantar aspect of a human foot at the anatomical Keystone. The embodiment of the reflex catalyst 43 consists of a membrane at its upper surface 48 and cavities 45 formed by the upper surface 48 and the vertical walls 46. FIGS. 5 *a, b*, and *c* illustrate an alternative embodiment of an insole or shoe midsole device 1 similar to that shown in FIGS. 4 *a, b*, and *c* except for the configuration of the reflex catalyst 43, which in this instance consists of holes 44 formed by the vertical walls 46. In the embodiments shown in FIGS. 4, *b* and *c* and FIGS. 5 *b* and *c*, the variable stimulus mechanisms' 8 reflex catalysts 43 plantar surfaces 49 do not contact the devices' 1 supporting surfaces 60 when reflex catalysts 43 deflect as a result of the sole of the foot's load-bearing forces. These embodiments create randomly located and varied intensity stimulus to the sole of the foot in response to the intensities of the sole of the foot's randomly localized load-bearing forces. The stimulus is produced by the deformation resistance forces created by the reflex catalysts' 43 elastic properties. The reflex catalysts' 43 elastic properties are created by the reflex catalysts' 43 resilient materials and the relative geometries of the reflex catalysts' 43 dome-like dorsal surfaces 48, holes 44, cavities 45, and vertical walls 46. When the reflex catalysts' 43 dome-like dorsal surfaces 48 are subject to randomly located load-bearing forces, the reflex catalysts' 43 dome-like dorsal surfaces 48 deflect away from the loading forces in the direction of the loading forces. As the sole of the foot's randomly localized load-bearing forces increase and are borne by the reflex catalysts' 43 dorsal surfaces 48, the dorsal surfaces 48 progressively deflect in relation to the increased forces. As the reflex catalysts' 43 dorsal surfaces 48 deflect a corresponding horizontal elastic recoil tension is created in the reflex catalysts' 43 plantar surfaces 49. The greater the reflex catalysts' 43 dorsal surface 48 deflection, the greater the elastic recoil tension in the reflex catalysts' 43 plantar surfaces 49. The intersections 49 of the reflex catalysts' 43 resiliently deformable vertical walls 46 exhibit greater deflection resistance and elastic recoil characteristics compared to the vertical walls 46, holes 44, and cavities 45. As a result, as the sole of the foot's localized load-bearing forces randomly shift in intensity and location during gait-related activities, varying deflections, in size and location, occur at corresponding locations on the reflex catalysts' 43 dorsal surface 48. The varied resistances created by the reflex catalyst's 43 varied localized deflections and elastic recoil characteristics create varied levels of randomly localized stimulus to the sole of the foot at the corresponding load-bearing areas.

Figure 6B:
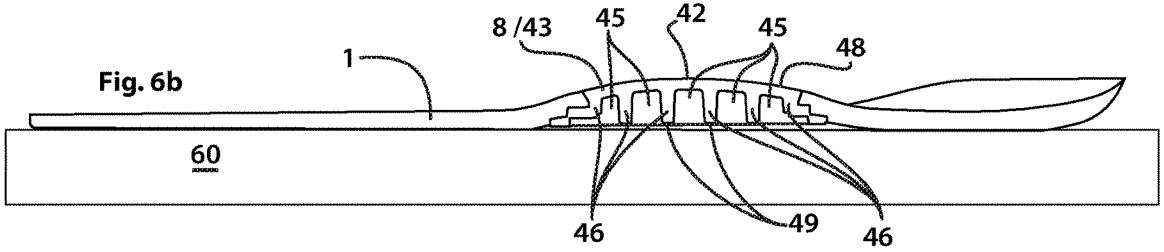
FIG. 6 *a* is a top plan view of a forth embodiment of the present invention, with a variable stimulus mechanism in position 5, with a third embodiment of the domed-shaped catalyst.
Figure 6C:
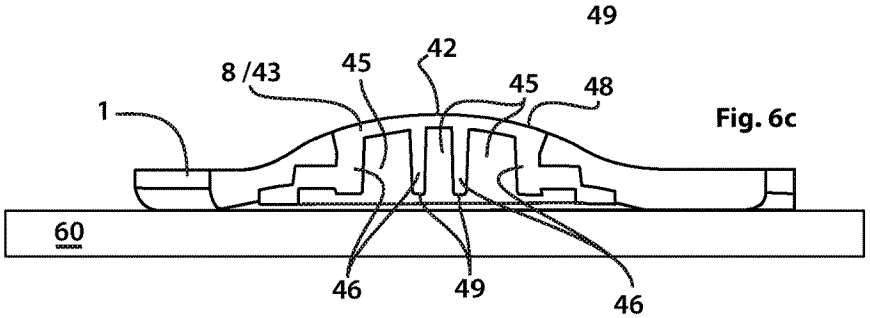
Figure 6A:
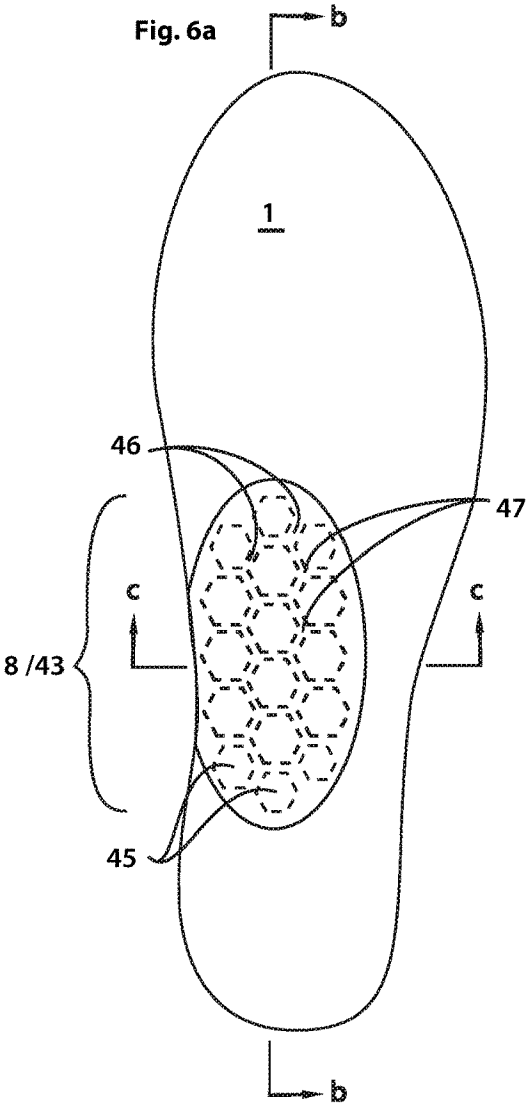
Figure 7B:
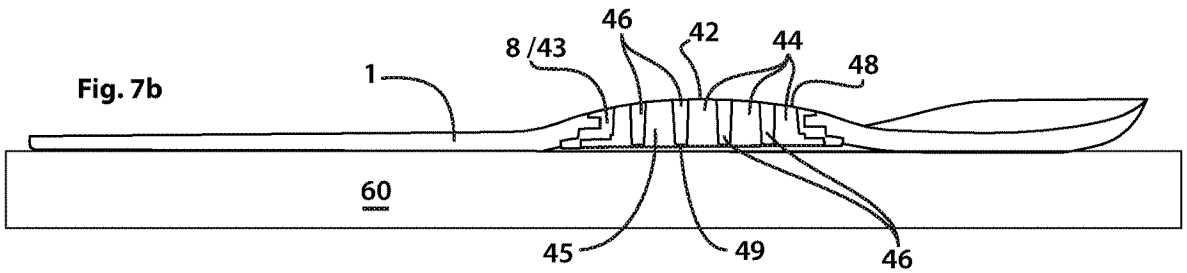
FIG. 7 *a* is a top plan view of a forth embodiment of the present invention, with a variable stimulus mechanism in position 5, with a forth embodiment of the domed-shaped catalyst.
Figure 7C:
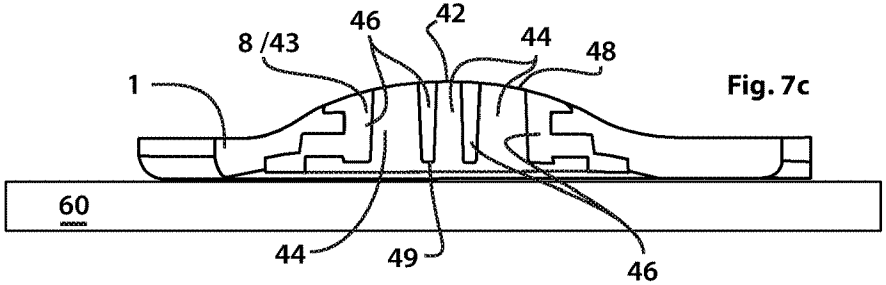
Figure 7A:
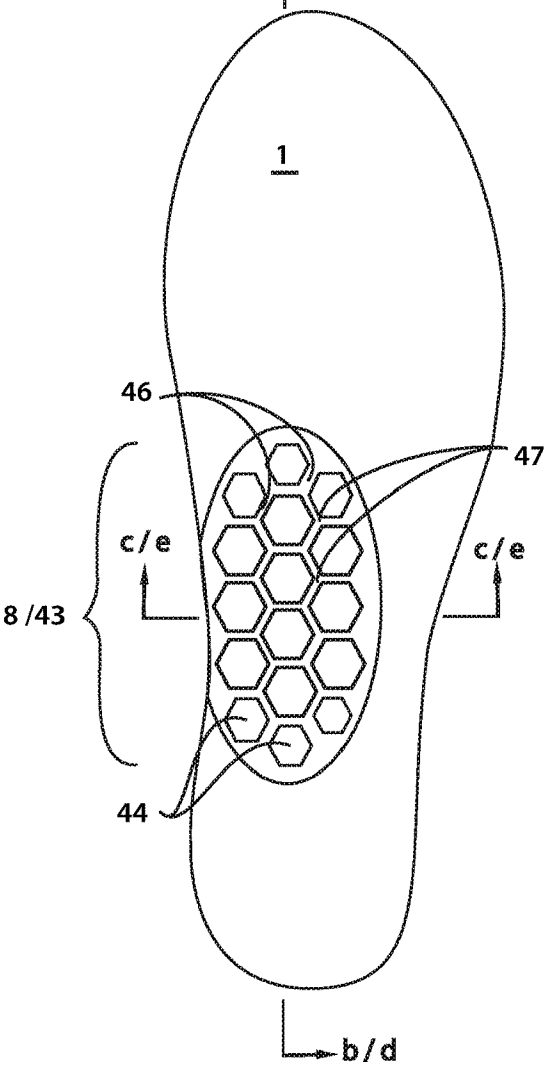
Figure 15B:
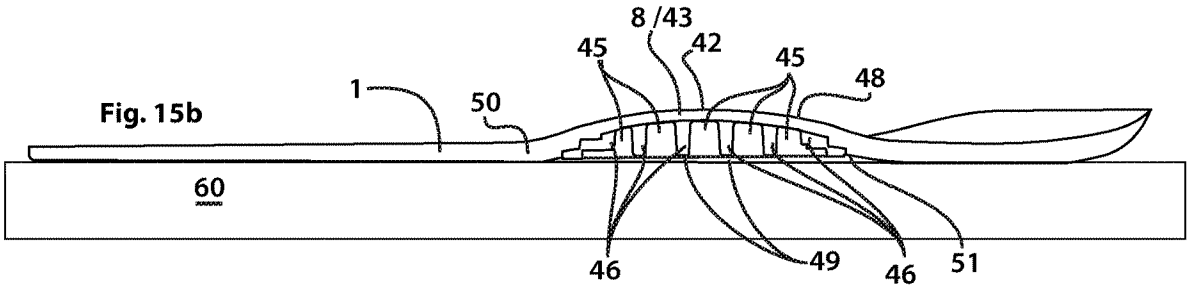
FIG. 15 *a* is a top plan view of a twelfth embodiment of the present invention.
Figure 15C:
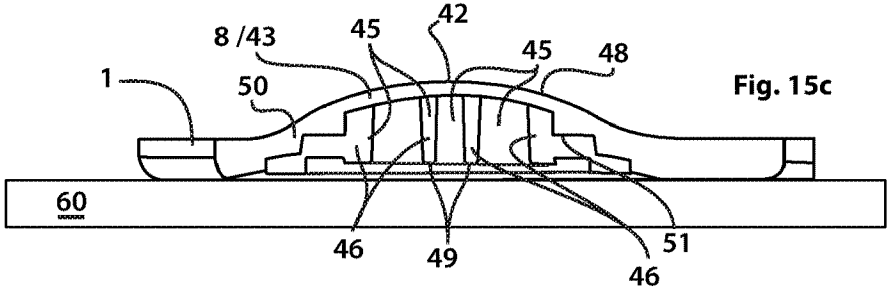
Figure 15A:
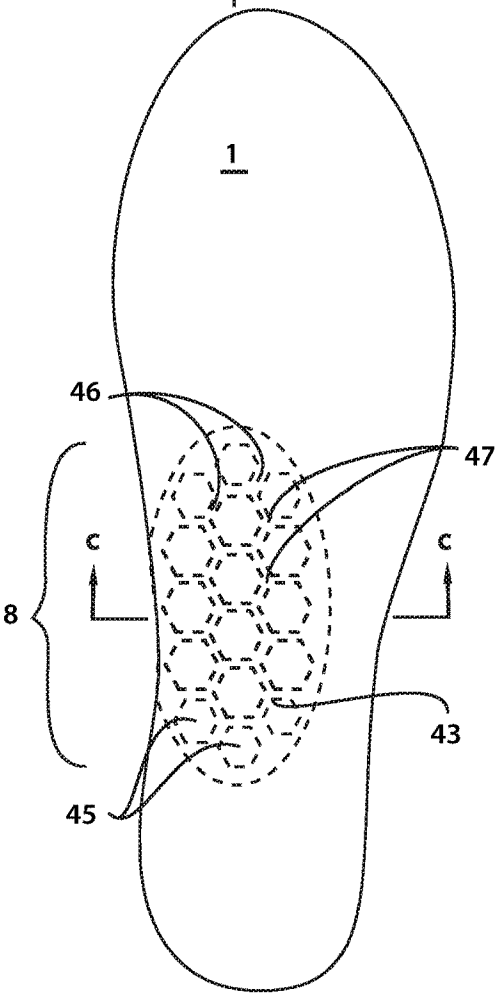

FIGS. 6 *a, b*, and *c* illustrate an alternative embodiment of an insole or footwear device 1 having an upper portion consisting of variable stimulus mechanism 8, located at load-bearing area 5 shown in FIG. 1. The embodiment illustrated may incorporate any of the variable stimulus mechanism's 7 configurations shown in FIG. 2 *c, d, h, i*, and *m* at any of the load-bearing area locations 2, 3, and 4 shown in FIG. 1. FIGS. 6 *b* and *c* illustrate the variable stimulus mechanisms' 8 upwardly reflex catalysts 43 located central to the foot's anatomical Keystone. The anatomical keystone being defined as intermediate cuneiform bone of the foot. The domes 43 having an apex 42 on the dorsal surface for aligning with the plantar aspect of a human foot at the anatomical Keystone. The embodiment in FIGS. 6 *a, b*, and *c* have a reflex catalyst 43 consisting of a membrane at its dorsal surface 48 and cavities 45 formed by the dorsal surface 48 and the vertical walls 46. The dome 43 having an apex 42 on the dorsal surface for aligning with the plantar aspect of a human foot at the anatomical Keystone. FIGS. 7 *a, b*, and *c* illustrate an alternative embodiment of an insole or shoe midsole device 1 similar to that shown in FIGS. 6 *a, b*, and *c* except for the configuration of the reflex catalyst 43, which in this instance consists of holes 44 formed by the vertical walls 46. FIGS. 15 *a, b*, and *c* illustrate an alternative embodiment of an insole or shoe midsole device 1 similar to that shown in FIGS. 6 *a, b*, and *c* and FIGS. 6 *a, b*, and *c* except for the configuration of the variable stimulus mechanism 8 reflex catalyst 43. The variable stimulus mechanism's 8 reflex catalyst 43 shown in FIGS. 15 *a, b*, and *c* consists of an insole body 50 molded from a resilient material such a foam, rubber, or plastic featuring a convex dorsal surface 48 and concave plantar surface 51 at the area 5 shown in FIG. 1, which form the variable stimulus mechanism's 8 dorsal surface 48 for. The insole body's 50 plantar surface 51 concavity receives a reflex catalyst 43 embodiment with holes 44 vertical walls 46 as shown in FIGS. 7 *a, b*, and *c* which combined with the insole body's 50 plantar surface 51 form cavities 45. In the embodiments shown in FIGS. 6, *b* and *c*, FIGS. 7 *b* and *c*, and FIGS. 15 *a, b*, and *c* the variable stimulus mechanisms' 8 reflex catalysts 43 plantar surfaces 49 contacts the devices' 1 supporting surfaces 60 when reflex catalysts 43 deflect as a result of the sole of the foot's load-bearing forces. When light load-bearing forces are applied to these embodiments, a very mild initial stimulus is created at the sole of the foot by the deflection of the reflex catalysts 43 prior to the reflex catalysts' 43 plantar surfaces 49 coming into contact with the supporting surface 60. The initial stimulus is the result of the resistance forces created by the elastic rebound nature of reflex catalysts' 43 resilient materials and the geometry of the reflex catalysts' 43 holes 44, cavities 45, and vertical walls 46. As the load-bearing forces increase on the reflex catalyst 43 and the reflex catalyst's 43 plantar surface 49 comes into contact with the supporting surface 60, the reflex catalysts' 43 vertical walls 46 progressively deform relative to the increased load-bearing forces. The intersections 47 of the reflex catalysts' 43 resiliently deformable vertical walls 46 exhibit greater deflection resistance compared to the vertical walls 46, holes 44, and cavities 45. As a result, as the sole of the foot's localized load-bearing forces randomly shift in intensity and location during gait-related activities, varying deformations occur at corresponding locations on the reflex catalysts' 43 dorsal surface 48. The varied resistance created, by the reflex catalysts' 43 varied localized deformations, results in secondary levels of varied randomly localized stimulus to the sole of the foot at the corresponding load-bearing areas.

FIGS. 8 through 14 illustrate alternative embodiments of the variable stimulus mechanism's 8 reflex catalyst 43 showing different hole 44, cavity 45, vertical wall 46 and intersection 47 characteristics. Any of these alternative stimulus mechanism 8 reflex catalyst 43 embodiments may be used in the insole or footwear device 1 embodiments shown in FIG. 6 and FIG. 7.

We claim:

1. A midsole or insole device for a shoe comprising:

a dome-shaped body configured to interface with an anatomical apex of a foot's domed-shaped arch, wherein the body includes a membrane spanning a plurality of resiliently deformable vertical walls that extend downward from the membrane, wherein a plurality of cavities are formed by the membrane and adjacent vertical walls, and wherein the body includes a dorsal surface on an upper surface of the membrane and a plantar surface, formed by bottom surfaces of the plurality of resiliently deformable vertical walls.

2. The device of claim 1 further comprising:

a variable stimulation mechanism configured to interface one of the metatarsal heads and the heel;

a second variable stimulation mechanism configured to interface a lateral aspect of the foot between the fifth metatarsal head and the heel;

wherein, during gait-related activities, the first variable stimulation mechanism produces stimulus of an intensity greater than the second variable stimulation mechanism;

wherein at least one of the first variable stimulation mechanism and the second variable stimulation mechanism comprises two bonded layers including a resilient stimulating upper layer and a less resilient stimulus-enhancing lower layer;

wherein the upper layer includes a plurality of holes that pass through the entirety of the upper layer; and wherein the lower layer includes a plurality of equally spaced upwardly facing projections aligned substantially perpendicular to an upper surface of the upper layer and positioned such that the projections align and interface with the plurality of holes in the upper layer.

3. The device of claim 1 wherein, during gait-related or weight-bearing activities, the vertical walls produce a plurality of stimuli, each stimulus having an intensity and a location, wherein the intensity of each stimulus at each location varies in response to varying levels and angles of compression, in response to pressure created by the shifting of weight.

4. The device of claim 1 wherein, during gait-related or weight-bearing activities, the vertical walls produce a plurality of stimuli, each stimulus having an intensity and a location, wherein the intensities of the plurality of stimuli vary from location to location in response to varying levels and angles of compression in response to pressure created by the shifting of weight.

5. The device of claim 1 wherein the vertical walls form a patterned surface selected from the group comprising of a honeycomb pattern, a pattern of circles, a pattern of oblong shapes, and a pattern of linear shapes.

* * * * *